US005722020A

United States Patent [19]

Matsuoka et al.

[11] Patent Number: 5,722,020

[45] Date of Patent: Feb. 24, 1998

[54] DEVELOPER CONTAINER AND DEVELOPER SUPPLYING APPARATUS

[75] Inventors: Isao Matsuoka; Yoshikazu Ikunami; Yozo Fujii, all of Hachioji, Japan

[73] Assignee: Konica Corporation, Japan

[21] Appl. No.: 760,949

[22] Filed: Dec. 9, 1996

[30] Foreign Application Priority Data

Dec. 12, 1995 [JP] Japan ..... 7-322653
Jan. 31, 1996 [JP] Japan ..... 8-015372

[51] Int. Cl.[6] ..... G03G 15/08

[52] U.S. Cl. ..... 399/262; 222/DIG. 1; 399/120

[58] Field of Search ..... 399/119, 120, 399/258, 260, 262; 222/DIG. 1, 325, 167; 220/253

[56] References Cited

U.S. PATENT DOCUMENTS

| | | | |
|---|---|---|---|
| 4,060,105 | 11/1977 | Feldeisen et al. | 141/363 X |
| 4,164,301 | 8/1979 | Thayer | 220/253 |
| 4,615,364 | 10/1986 | Kawata | 141/364 |
| 4,937,628 | 6/1990 | Cipolla et al. | 222/DIG. 1 |
| 5,005,517 | 4/1991 | Fukui et al. . | |
| 5,049,941 | 9/1991 | Manno et al. . | |
| 5,111,976 | 5/1992 | Ban | 222/DIG. 1 |
| 5,123,574 | 6/1992 | Poulos | 220/253 X |
| 5,441,177 | 8/1995 | Yanagisawa | 222/167 |
| 5,500,719 | 3/1996 | Ichikawa et al. | 399/238 |
| 5,564,607 | 10/1996 | Miller et al. | 222/325 |
| 5,566,850 | 10/1996 | Forsyth et al. | 220/253 |
| 5,589,919 | 12/1996 | Ikunami et al. | 399/262 |
| 5,627,631 | 5/1997 | Ichikawa et al. | 222/DIG. 1 |
| 5,648,840 | 7/1997 | Ikunami et al. | 399/119 |

FOREIGN PATENT DOCUMENTS

| | | |
|---|---|---|
| 0604999 | 7/1994 | European Pat. Off. . |
| 0712058 | 5/1996 | European Pat. Off. . |
| 4017458 | 12/1990 | Germany . |

OTHER PUBLICATIONS

European Search Report EP 96 11 9762 with Annex.

*Primary Examiner*—Matthew S. Smith
*Attorney, Agent, or Firm*—Jordan B. Bierman; Bierman, Muserlian and Lucas LLP

[57] ABSTRACT

The image forming apparatus includes: a developing device to develop an image by using developer; a developer container portion to supply the developer to the developing device; a developer cartridge which is attachable to or detachable from the developer container portion; and a driving means to rotate the developer cartridge. The developer cartridge further includes the following: a) a cartridge main body having a shape which facilitates movement of the developer toward a developer supply port by being rotated around a rotation axis by the driving means; b) a developer supply portion having the developer supply port to supply the developer to the image forming apparatus; and c) an opening/closing covering member to open and close the developer supply port. The opening/closing covering member includes an engagement member to connect the developer supply port with the opening/closing covering member so that the engagement member positions the opening/closing covering member at an opened state of the developer supply port when the developer cartridge is mounted in the image forming apparatus and the developer cartridge is rotated around the rotation axis.

16 Claims, 24 Drawing Sheets

FIG. 15 ( a )
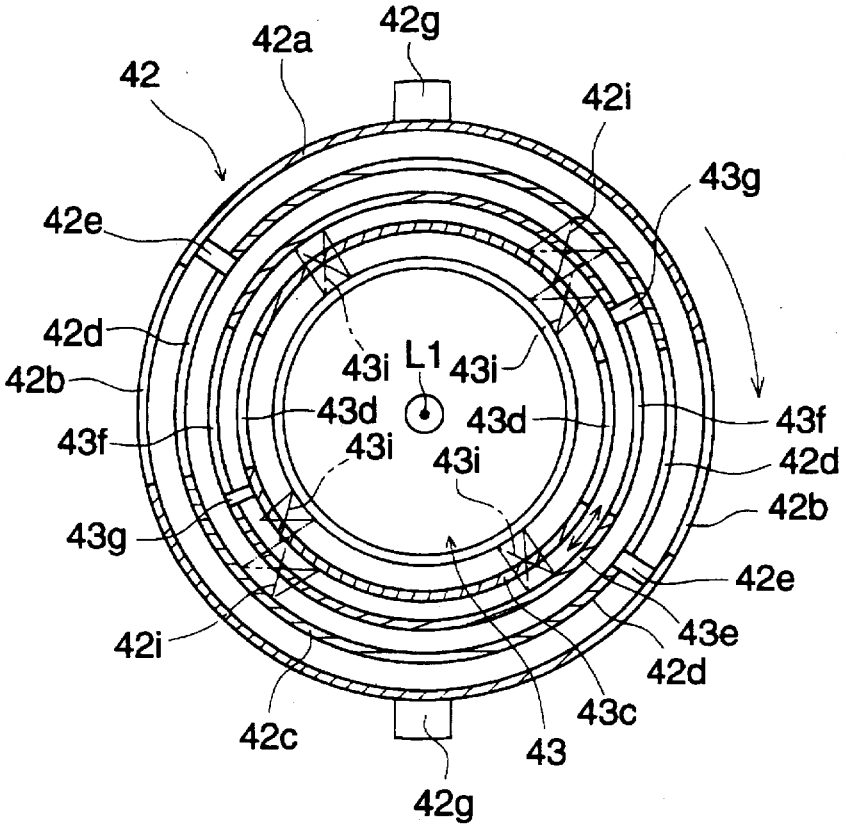
FIG. 15 ( b )
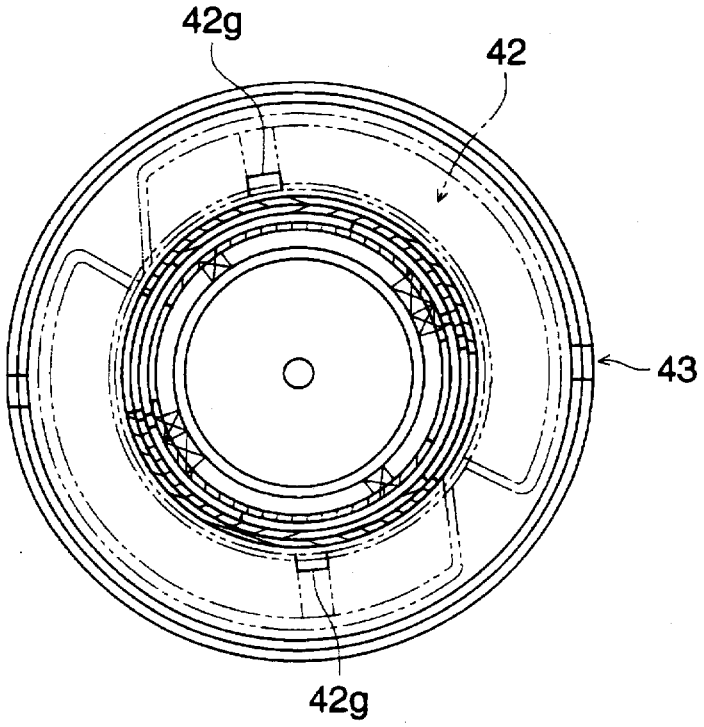

DEVELOPER CONTAINER AND DEVELOPER SUPPLYING APPARATUS

BACKGROUND OF THE INVENTION

The present invention relates to an image forming apparatus provided with a developer cartridge which is rotated by a developer supply driving operation while the developer cartridge is mounted in a developer cartridge holder, and which supplies developer into a developer container portion, and to an image forming apparatus provided with a developer supplying apparatus in which a developer cartridge holder is rotated by a developer supply driving operation while the developer cartridge is mounted in the developer cartridge holder, and which supplies developer into a developer container portion.

As image forming apparatus, there are color laser printers, or similar apparatus, provided with a developer supplying apparatus in which, for example, a developer cartridge is mounted in a developer cartridge holder, and the developer cartridge holder is rotated by a developer supply driving operation while a developer cartridge is mounted in the developer cartridge holder, so that developer is supplied into the developer container.

Further, there is also a developer supplying apparatus in which a developer cartridge is mounted in the apparatus main body, and which is provided with a mechanism to take off an inner plug, which closes a developer supply port of the developer cartridge so that the developer can not flow out, (for example, Japanese Patent Publication Open to Public Inspection No. 20701/1995).

Incidentally, in the developer supplying apparatus, it can be considered that the developer cartridge is mounted in the developer cartridge holder of the apparatus main body while the developer cartridge is being rotated. However, in this case, the developer cartridge holder is rotated being provided with the developer cartridge, and thereby, when the developer cartridge is mounted in the developer holder, the developer cartridge holder is rotated, which makes it difficult to mount the developer cartridge in the developer cartridge holder, which is disadvantageous.

Further, when the inner plug which closes the cartridge developer supply port of the developer cartridge, is taken off, considerable power is required, and a mechanism to take off the inner plug becomes larger, resulting in an increase in size of the apparatus and its cost, which is another problem.

SUMMARY OF THE INVENTION

The present invention has been attained in view of the above-described problems. An object of the present invention is to provide a developer cartridge with a simple structure, which can be securely attached to and detached from a developer cartridge holder; and developer can be supplied by opening/closing a cartridge developer supplying port of the developer cartridge. Further, another object of the present invention is to provide an image forming apparatus in which a structure is simple; attachment and detachment of the developer cartridge can be securely achieved; a cartridge developer supplying port of the developer cartridge can be securely opened and closed; and the overall size of the apparatus is reduced, and cost is reduced.

In order to solve the above problems, an image forming apparatus according to the present invention includes the following. That is, the image forming apparatus includes: a developing device to develop an image by using developer; a developer container portion to supply the developer to the developing device; a developer cartridge which is attachable to or detachable from the developer container portion; and a driving means to rotate the developer cartridge. The developer cartridge further includes the following: a) a cartridge main body having a shape which facilitates movement of the developer toward a developer supply port by being rotated around a rotation axis by the driving means; b) a developer supply portion having the developer supply port to supply the developer to the image forming apparatus; and c) a plurality of opening/closing cap members to open and close the developer supply port. The plurality of opening/closing cap members include an engagement member to connect the plurality of opening/closing cap members to each other, and the plurality of the opening/closing cap members are structured so that they are successively opened and closed by the engagement member when the developer cartridge is rotated around the rotation axis under the condition that it is mounted in the image forming apparatus.

The image forming apparatus further includes a developer cartridge holder portion to hold the developer cartridge, and the developer cartridge holder portion further has a drive regulation means to stop rotation of the driving means when the opening/closing cap members are opened and closed.

The image forming apparatus further includes a developer cartridge holder portion to hold the developer cartridge, and the developer cartridge holder portion further has a supply guide for sliding and falling the developer toward the developer container portion.

The image forming apparatus is sometimes structured such that the direction of the opening/closing motion of the plurality of opening/closing cap members of the developer cartridge is either parallel to the rotation axis or perpendicular to the axis.

Further, in the image forming apparatus, the developer supply portion of the developer cartridge further has a guiding-recess portion to guide the developer toward the developer supply port by rotation of the cartridge main body.

Still further, in the image forming apparatus, when the direction of the opening/closing motion of the plurality of opening/closing cap members is perpendicular to the rotation axis, the developer supply portion of the developer cartridge further has an inclined surface portion for sliding and falling the developer, which has been guided to the developer supply port by the guiding-recess portion, to the image forming apparatus.

BRIEF DESCRIPTION OF THE DRAWINGS

FIGS. 15(*a*) and 15(*b*) are sectional views showing a condition in which the developer cartridge is mounted into the developer cartridge holder.

DETAILED DESCRIPTION OF THE PREFERRED EMBODIMENT

Figure 1:
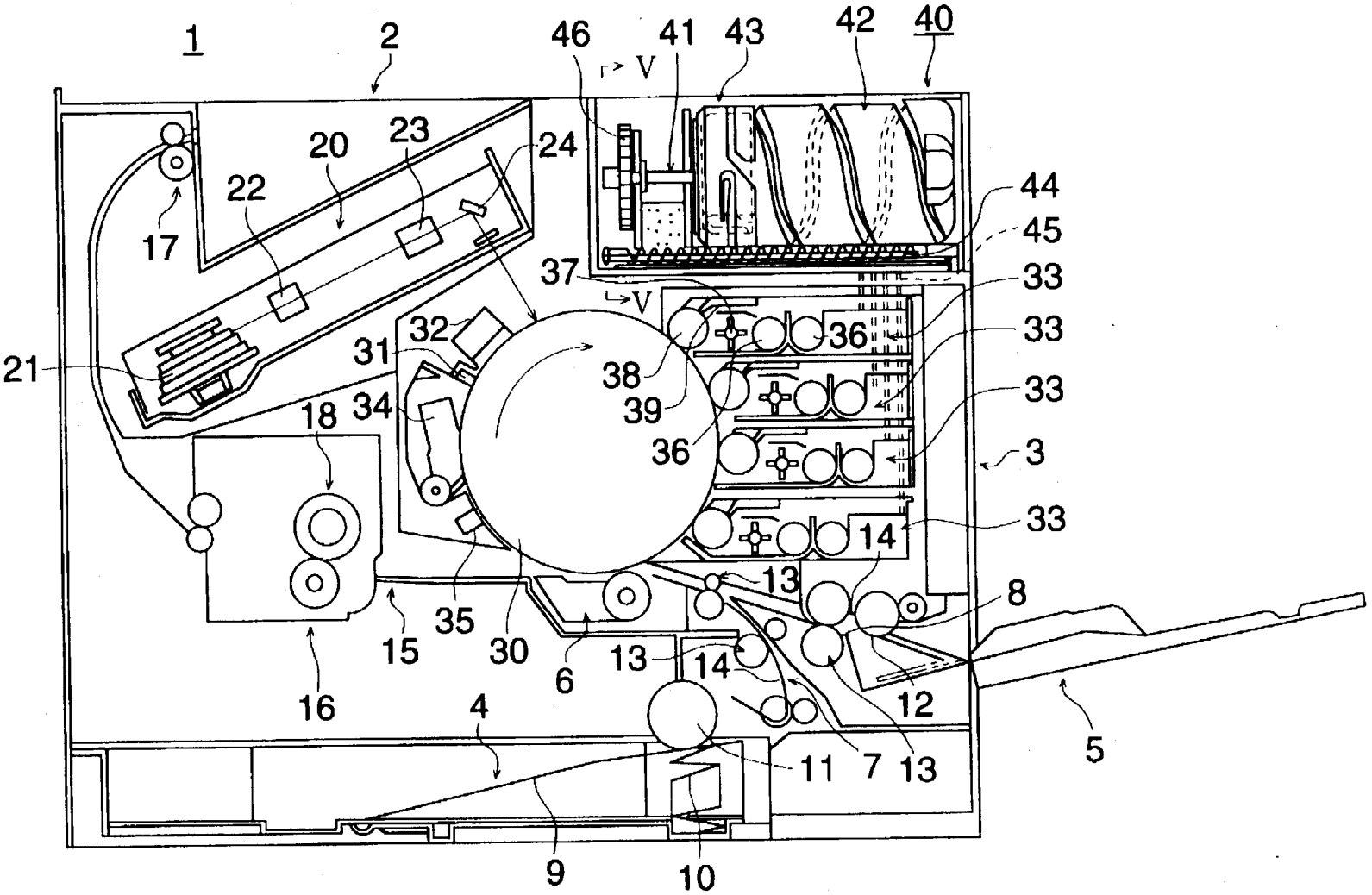
FIG. 1 is a view showing the general structure of an image forming apparatus.

An example of a developer cartridge and an image forming apparatus of the present invention will be described below. Initially, an example of an image forming apparatus shown in FIGS. 1 through 19, will be described.

In a color laser printer as an image forming apparatus 1, a frame 3 is provided in an apparatus main body 2 in such a manner that it can be horizontally pulled out of the front of an apparatus main body 2. An automatic sheet feed cassette 4 is located in the lower portion of the apparatus main body 2, and a sheet by-pass cassette 5 is located on a front side wall so that it can be opened and closed. Sheet feed conveyance paths 7 and 8, which convey a recording sheet from respective cassettes to a transfer section 6, are formed of these cassettes. A base plate 9, which is provided in the automatic sheet feed cassette 4, is forced by a spring 10 so that a recording sheet, which has been set in the cassette, is always in contact with a sheet feed roller 11, and is sent to the sheet feed conveyance path 7 one by one sheet by the drive of the sheet feed roller 11. Recording sheets set in the sheet by-pass cassette 5 are sent to the sheet feed conveyance path 8 one by one, by the drive of a sheet feed roller 12. The sheet feed conveyance paths 7 and 8 are integrated in a transfer section 6 side. Paired conveyance rollers 13 and a conveyance guide 14 are respectively provided in the sheet feed conveyance paths 7 and 8, and thereby, the recording sheet is conveyed onto the transfer section 6 at predetermined timing.

The transfer section 6 is arranged at a opposed position to an image carrier 30, and multi-color images on the peripheral surface of the image carrier 30 are collectively transferred onto the recording sheet. A fixing section 16 and a delivery roller 17 are arranged in a delivery conveyance path 15 of the recording sheet on which an image has been transferred, and the recording sheet separated from the transfer section 6 is conveyed to a fixing section 16. The fixing section 16 is composed of two pressure-contact rollers 18 in which a heater is provided inside at least one of the two rollers. When heat and pressure are applied between these two pressure-contact rollers 18, adhered toner is fused and fixed onto the recording sheet. After that, the recording sheet is delivered from a delivery conveyance path 15 outside of the apparatus by the delivery roller 17.

An image writing section 20 is provided in the apparatus main body 2, by which image exposure is carried out on the peripheral surface of the image carrier 30 according to an image signal. By the image writing section 20, rotational scanning is carried out by a rotational polygonal mirror 21, using laser light beams emitted from a laser light source; an optical path of the laser light beam is deflected by a reflection mirror 24 through an fθ lens 22 and a filter 23, and projected onto the peripheral surface of the previously charged image carrier 30; and consequently a latent image is formed on the surface of the image carrier 30.

The image carrier 30 is provided in the frame 3 so that it can be rotated in one way (clockwise in the drawing). Further, in the frame 3, a PCL 31, a charger 32, developing devices 33, a cleaning section 34 and a discharger 35 are arranged around the image carrier 30. After any charge during previous printing has been eliminated by the discharge of the PCL 31, the peripheral surface of the image carrier is again uniformly charged by the charger 32, and stands by for a new printing operation. After this uniform charging, new image exposure is carried out by the image writing section 20 according to a new image signal.

Developing devices 33 in which developer, composed of mixed agents of a toner of yellow (Y), magenta (M), cyan (C) and black (K), and a magnetic carrier, is loaded, are provided around the image carrier 30. A stirring screw 36, a conveyance rotating body 37, and a developer carrier 38 are provided in each developing device 33. Initially, the first color development is carried out by the rotating developer carrier 38, in which a magnet is housed. The developer, on the developer carrier 38, is regulated to a predetermined thickness by a regulating bar 39, and is conveyed to a developing area. An AC bias voltage and a DC bias voltage are superimposed and applied between the image carrier 30 and the developer carrier 38, and a latent image is visualized by commonly known methods.

After the first color development has been thus completed, the apparatus enters into the second color (magenta) image forming process, and the image carrier 30 is uniformly charged again. The same image forming process is carried out for the third color (cyan), and also the fourth color (black), and thereby, the development for a total of four colors is carried out on the image carrier 30.

Figure 2:
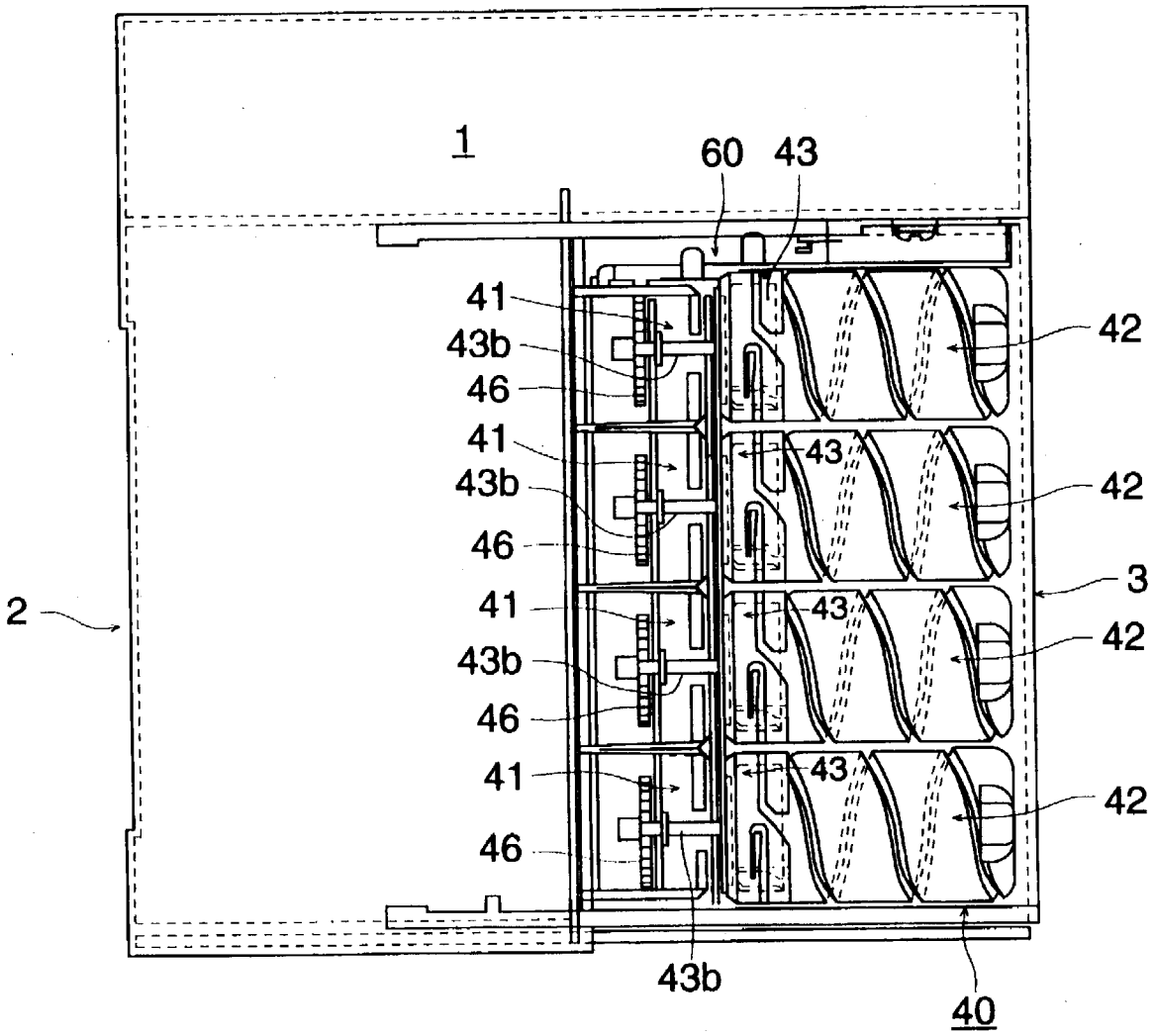
FIG. 2 is a plan view of the image forming apparatus.
Figure 3:
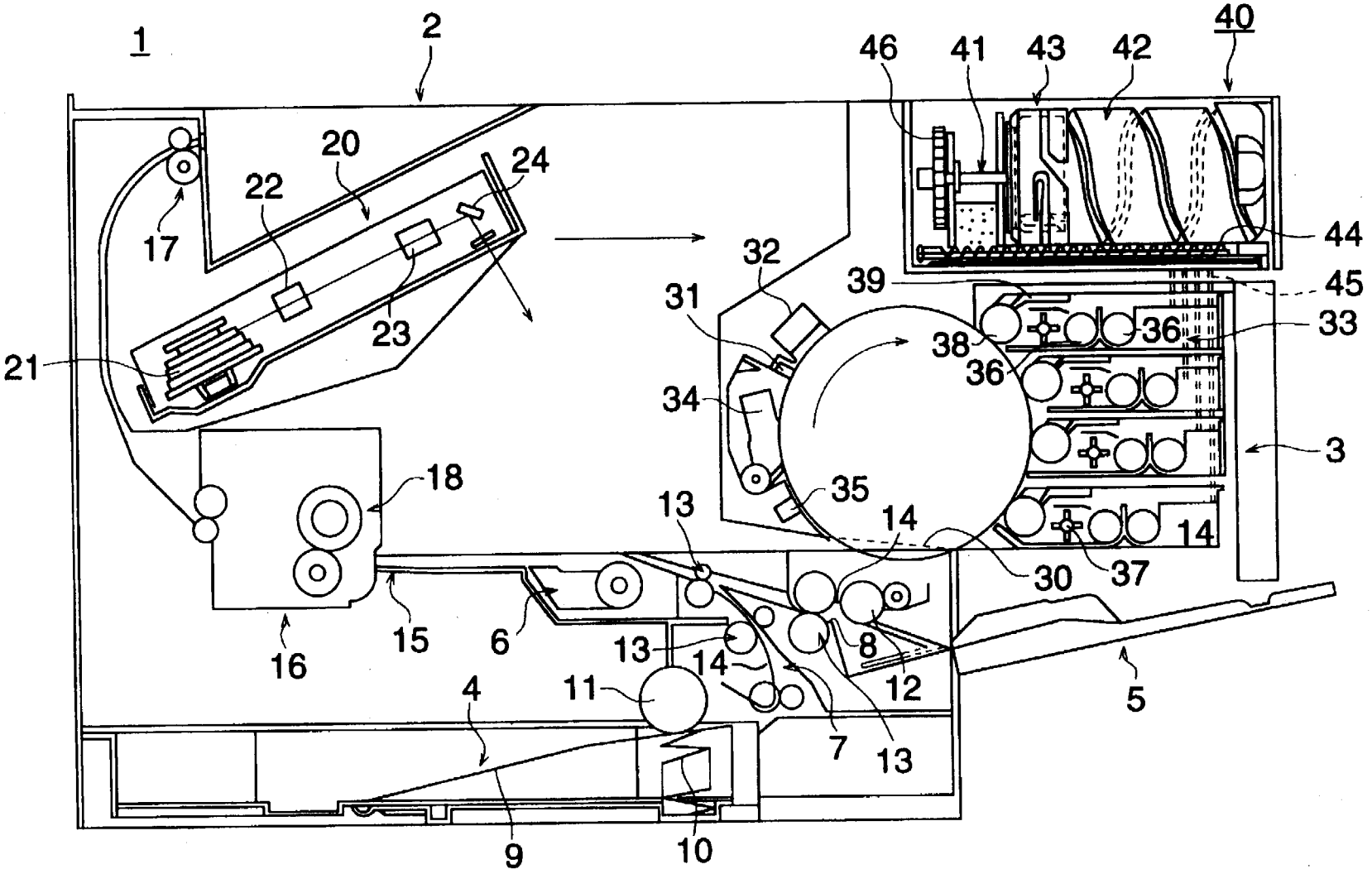
FIG. 3 is the general structural view showing a condition in which a frame of the image forming apparatus is pulled out.
Figure 4:
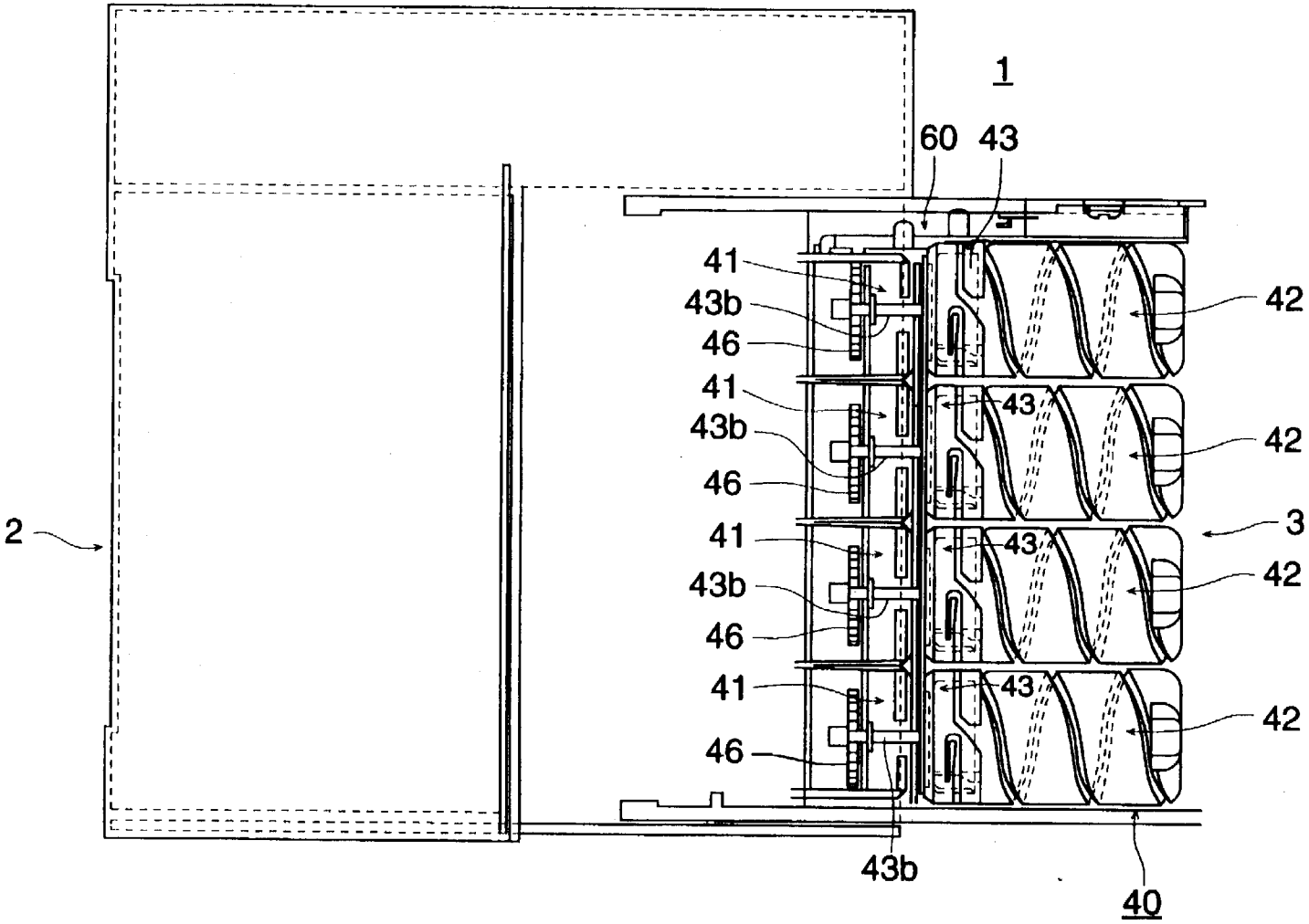
FIG. 4 is a plan view showing a condition in which a frame of the image forming apparatus is pulled out.

A developer supplying apparatus 40 is provided in the frame 3, and a 4-color developer container portion 41 and a developer cartridge 42 to supply developer to the developer container portion 41, are provided in the developer supplying apparatus 40. As shown in FIGS. 1 and 3, the developer container portion 41 and the cartridge 42 are provided in the upper portion of the apparatus main body, and as shown in FIGS. 2 and 4, the 4-color developer container portion 41 and the developer cartridge 42 are arranged parallel to each other.

The developer cartridge 42 is mounted into the developer cartridge holder portion 43 while the developer cartridge 42 is being rotated. When the developer cartridge holder portion 43 is rotated under the above condition, developer is supplied from the developer cartridge 42 to the developer container portion 41 through a supplying guide 43*a* of the developer cartridge holder portion 43. Developer conveyance means 44 are provided in the lower portion of the 4-color developer container portion 41, corresponding to each color developer. By the rotation of the developer conveyance screw 44, developer in the developer container portion 41 is guided to a supplying path 45 provided corresponding to each developing device 33, and is dropped from supplying path 45 for supplying the developer into the corresponding developing device 33.

Figure 8:
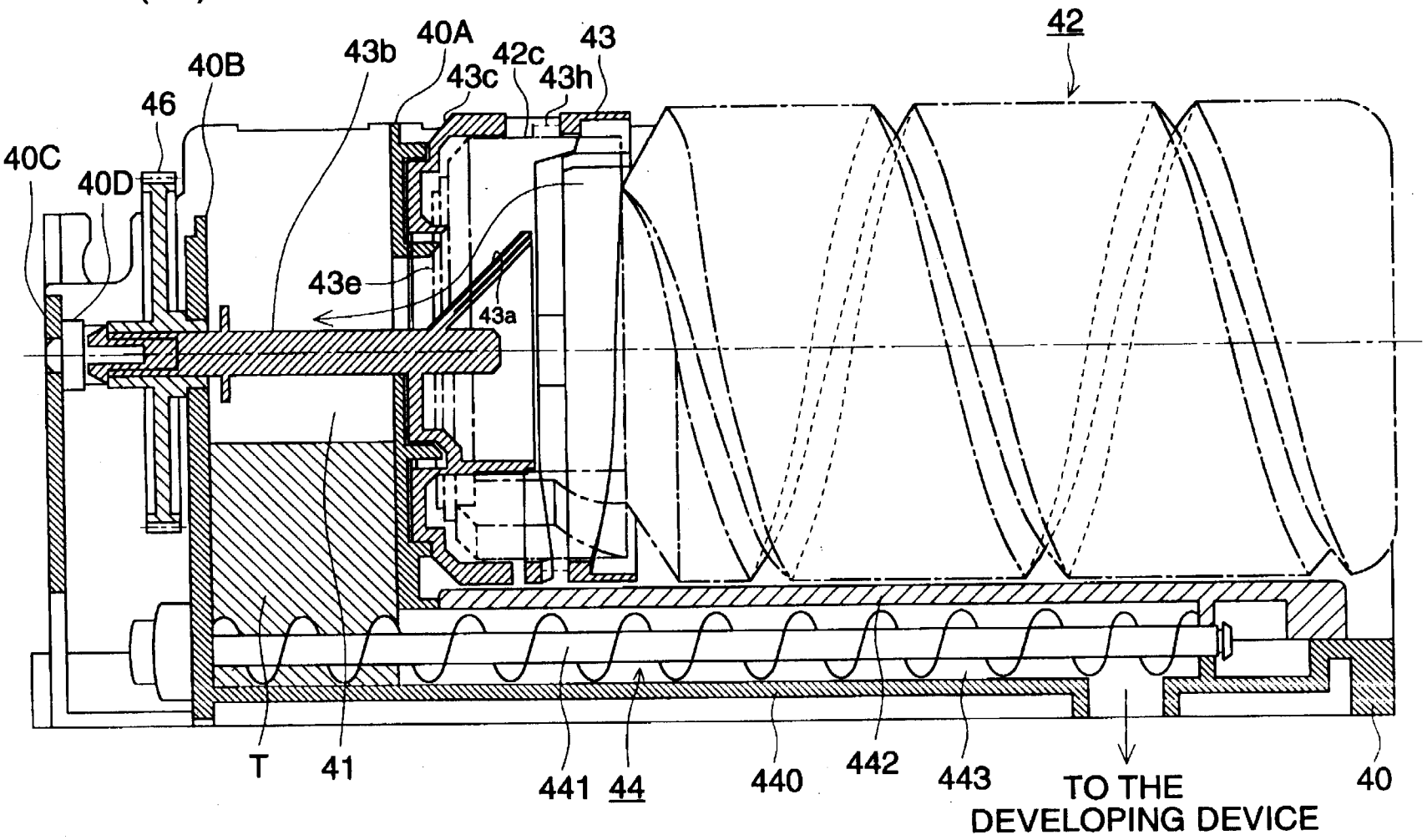
FIGS. 8(*a*) through 8(*d*) are sectional views showing a condition in which a developer cartridge is mounted in a developer cartridge holder.
Figure 8:
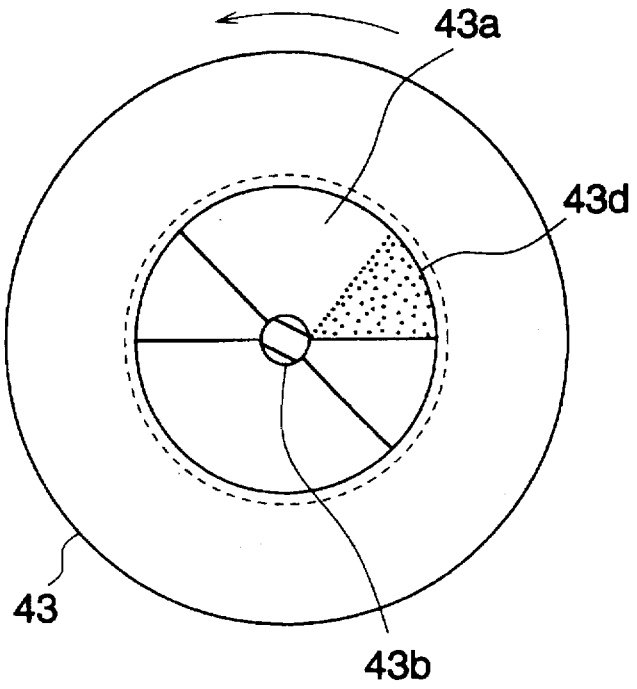
Figure 8:
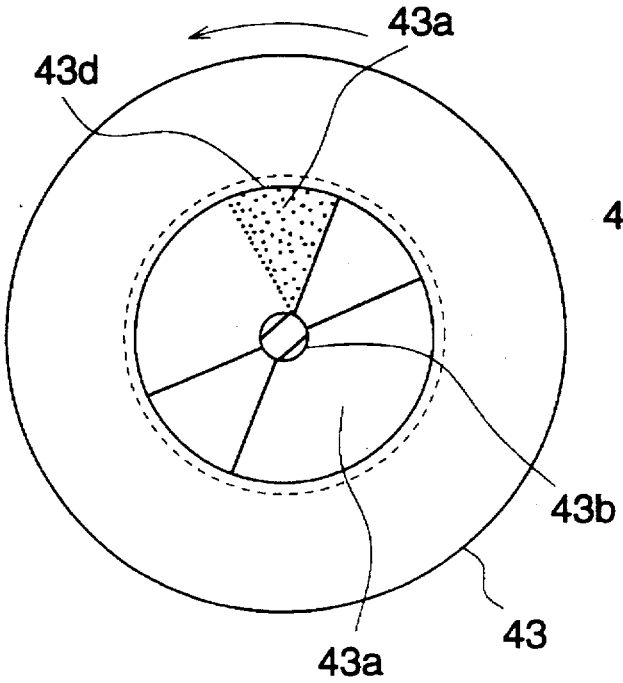
Figure 8:
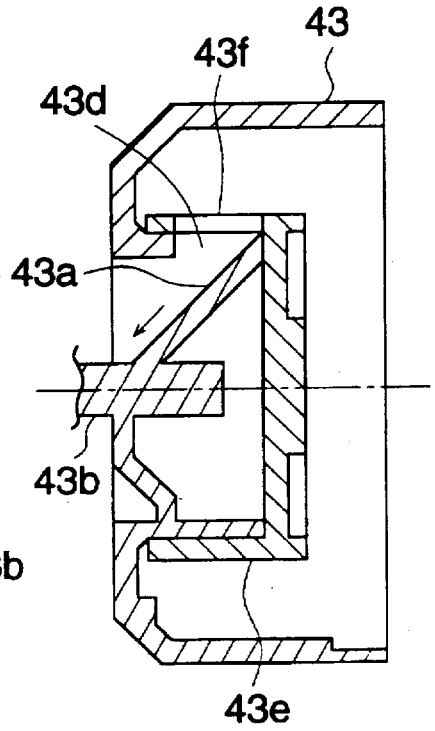

As shown in FIG. 8(*a*), a shaft portion 43*b* is integrally formed with the supplying guide 43*a* in the developer cartridge holder portion 43, and pivotally supported rotatably by the developer container portion 41. A driven gear 46 is provided on a tip portion of the shaft portion 43*b*. The driven gear 46 is engaged and interlocked with respective coupling gear 47.

Figure 5:
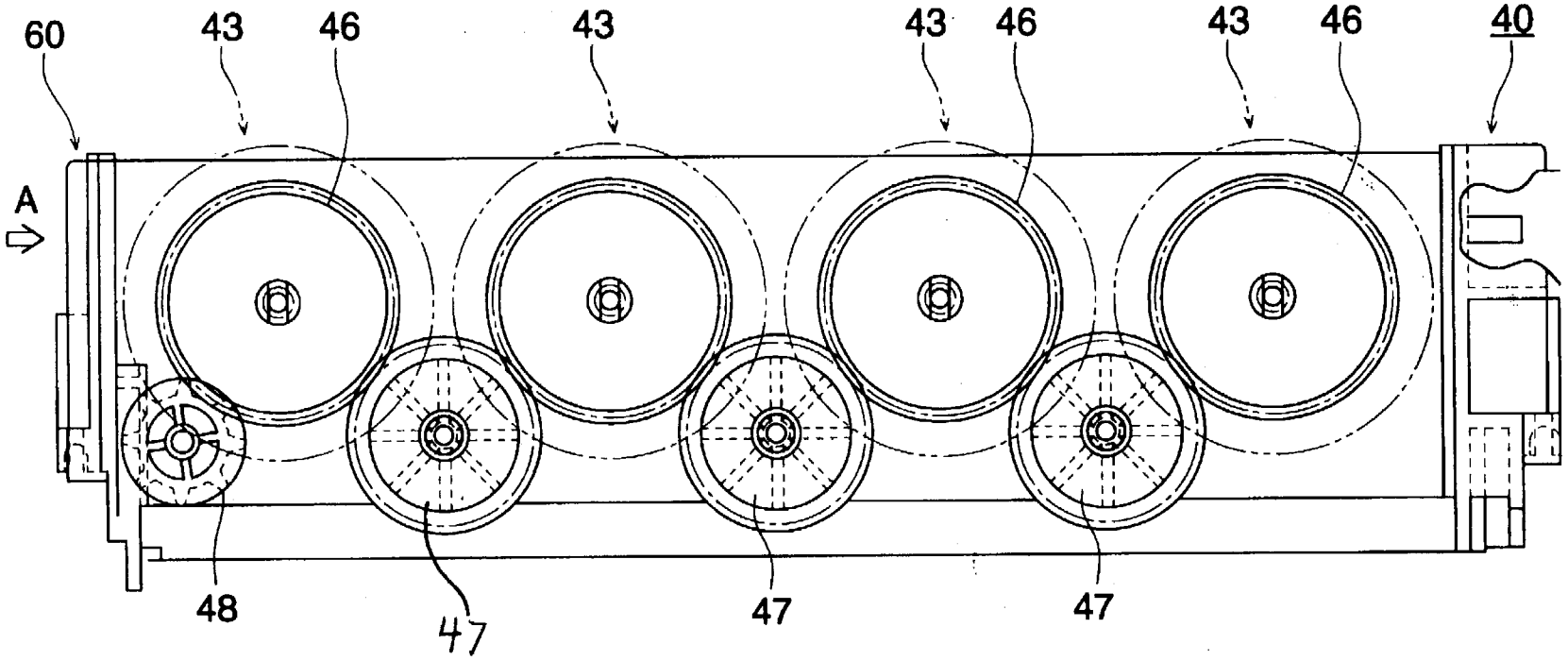
FIG. 5 is a sectional view along V—V in FIG. 1.
Figure 6:
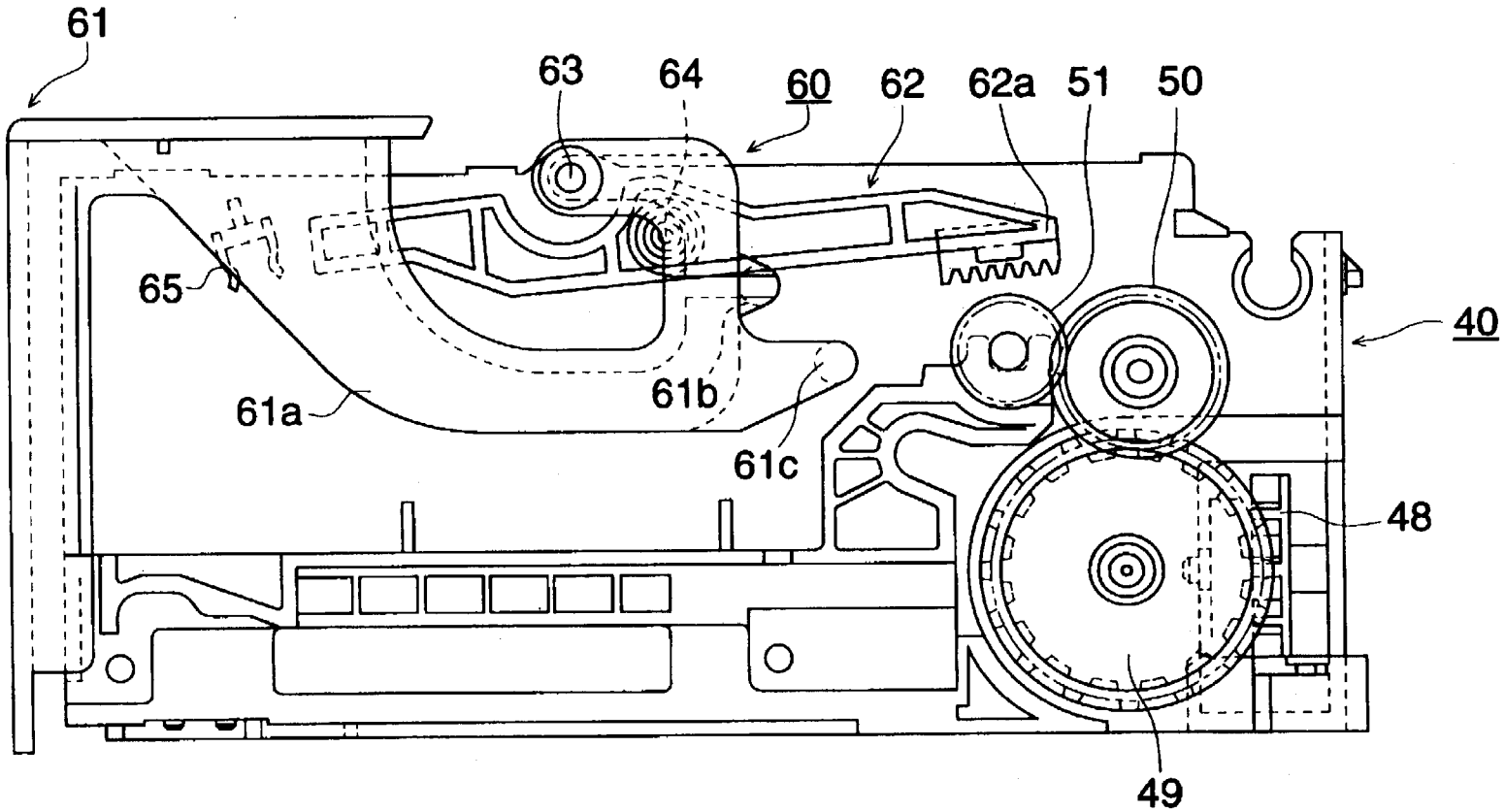
FIG. 6 is a view showing a condition in which a cartridge attachment/detachment door is closed, which is viewed from direction A in FIG. 5.
Figure 7:
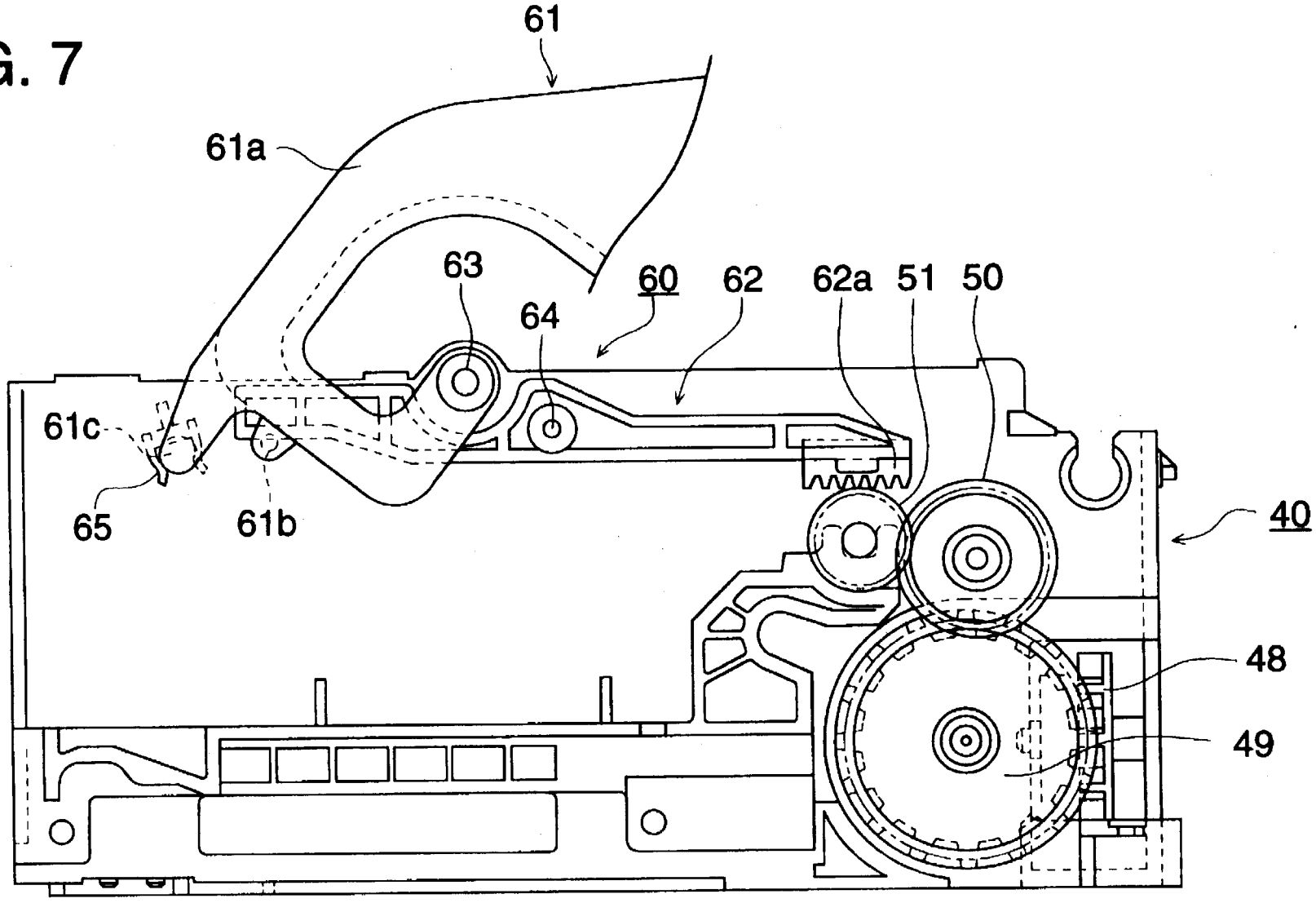
FIG. 7 is a view showing a condition in which the cartridge attachment/detachment door is opened, which is viewed from direction A in FIG. 5.

In the developer cartridge holder portion 43 arranged one side of the frame 3, the driven gear 46 is engaged with a direction changing gear 48 as shown in FIGS. 5 through 7. This direction changing gear 48 is engaged with a large diameter intermediate gear 49, and the direction of rotation is changed by 90°. The large diameter intermediate gear 49 is connected to a drive gear 51 through a small diameter intermediate gear 50 as shown in FIGS. 6 and 7. The drive gear 51 is engaged with a gear, not shown in the drawing, which transmits a driving force from the apparatus main body 2. The rotational driving force of the drive gear 51 is transmitted to the driven gear 46 of the developer cartridge holder portion 43 through the small diameter intermediate gear 50, the large diameter intermediate gear 49, and the direction changing gear 48, and thus the 4-color developer cartridge holder portion 43 is respectively interlocked and rotated through coupling gears 47.

A drive regulation means 60 to regulate the driving operation for developer supply when the developer cartridge 42 is attached to or detached from the developer cartridge holder portion 43 is provided in the frame 3. As shown in FIG. 7, the drive regulation means 60 regulates the driving operation for developer supply by moving a regulation lever 62 in the direction of regulation when a developer cartridge attachment/detachment door 61 is opened. As shown in FIG. 6, the drive regulation means 60 releases the regulation for the driving operation for the developer supply by moving a regulation lever 62 in the direction of regulation release when the developer cartridge attachment/detachment door 61 is closed. The developer cartridge attachment/detachment door 61 is provided in the frame 3 so that it is rotate around a supporting pin 63, and is also provided as a cover of the frame 3. The developer cartridge attachment/detachment door 61 is opened or closed when the developer cartridge 42 is attached into or detached from the developer cartridge holder portion 43, and a protrusion 61*b* and a stopper portion 61*c* are formed on an arm portion 61*a*. The regulation lever 62 is provided in the frame 3 so that it is rotatable around a supporting pin 64, and is structured such that a claw portion 62*a* engages with and disengages from the drive gear 51. When the claw portion 62*a* of the regulation lever 62 is engaged with the drive gear 51, rotation of the drive gear 51 is regulated, and when it is disengaged from the drive gear 51, the drive gear is free to rotate.

The developer cartridge attachment/detachment door 61 moves the regulation lever 62, and when the developer cartridge attachment/detachment door 61 is closed, the protrusion 61*b* lifts up the claw portion 62*a* side of the regulation lever 62 as shown in FIG. 6. Thereby, the claw portion 62*a* is not engaged with the drive gear 51, so that the drive gear 51 is rotated. On the other hand, when the developer cartridge attachment/detachment door 61 is opened, the protrusion 61*b* lifts up the opposite side of the claw portion 62*a* of the regulation lever 62, and the stopper portion 61*c* is engaged with a engagement portion 65 and maintained. Thereby, the claw portion 62*a* is engaged with the drive gear 51 and the rotation is stopped.

As described above, when the developer cartridge 42 is attached into and detached from the developer cartridge holder portion 43, drive for the developer supply is regulated. For example, when the developer cartridge 42 is replaced, the developer cartridge holder portion 43 is stopped, and therefore, the developer cartridge 42 is easily attached into and detached from the developer cartridge holder portion 43, so that the maintenance operation can be easily and rapidly carried out.

Further, when the developer cartridge attachment/detachment door 61 is opened, driving for the developer supply is regulated, and when the developer cartridge attachment/detachment door 61 is closed, regulation for the drive for the developer supply is released. The developer cartridge attachment/detachment door 61 is assuredly opened when the developer cartridge 42 is attached, and when it is detached, the developer cartridge attachment/detachment door 61 is assuredly closed. Therefore, a special opening/closing mechanism for the developer cartridge attachment/detachment door 61 is not necessary. Thereby, the structure is simple, attachment and detachment of the developer cartridge 42 is easier, and leakage of the developer can be prevented.

When the regulating means for developer supply driving is provided by connection to the developer cartridge attachment/detachment door 61, it can be assuredly regulated at a lower cost, compared to a developer supply driving regulation with electrical components such as solenoids, or the like.

Incidentally, the drive regulation means to regulate the drive for rotating the developer cartridge 42 is not limited to this, but may be directly provided on the developer cartridge attachment/detachment door 61. Further, when the developer cartridge 42 is attached to and detached from the developer cartridge holder portion 43, opening and closing of the developer cartridge attachment/detachment door 61 is detected, and driving may be regulated by a solenoid.

In the developer supply apparatus 40, the developer cartridge 42 can be attached into and detached from the developer cartridge holder 43 while being rotated. Under the condition that the developer cartridge 42 is attached into the developer cartridge holder portion 43, the developer supplying apparatus 40 is rotated by the developer supply driving operation, and thus supplies developer into the developer container portion 41.

Figure 9:
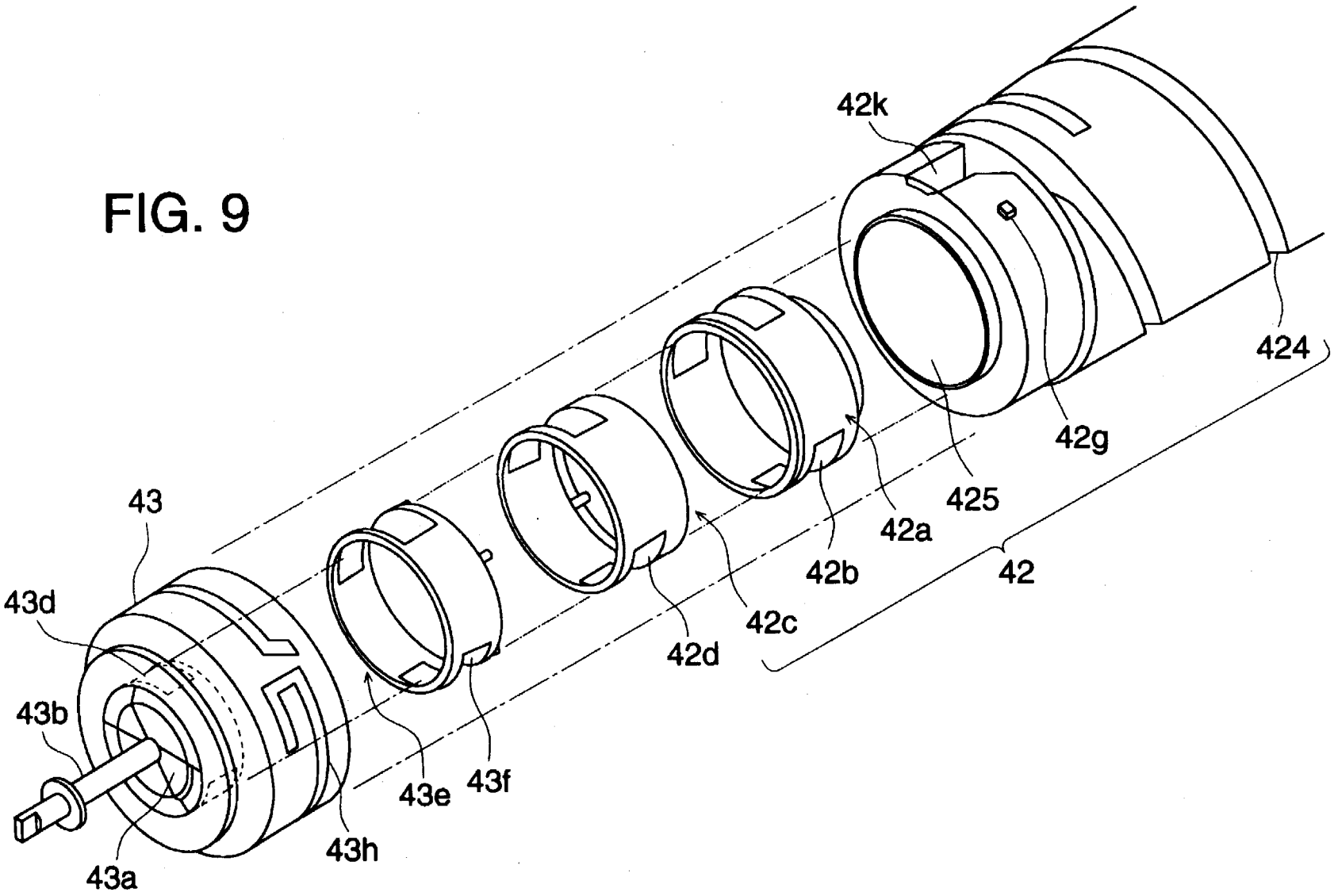
FIG. 9 is an disassembled perspective view showing the developer cartridge and the developer cartridge holder.
Figure 10:
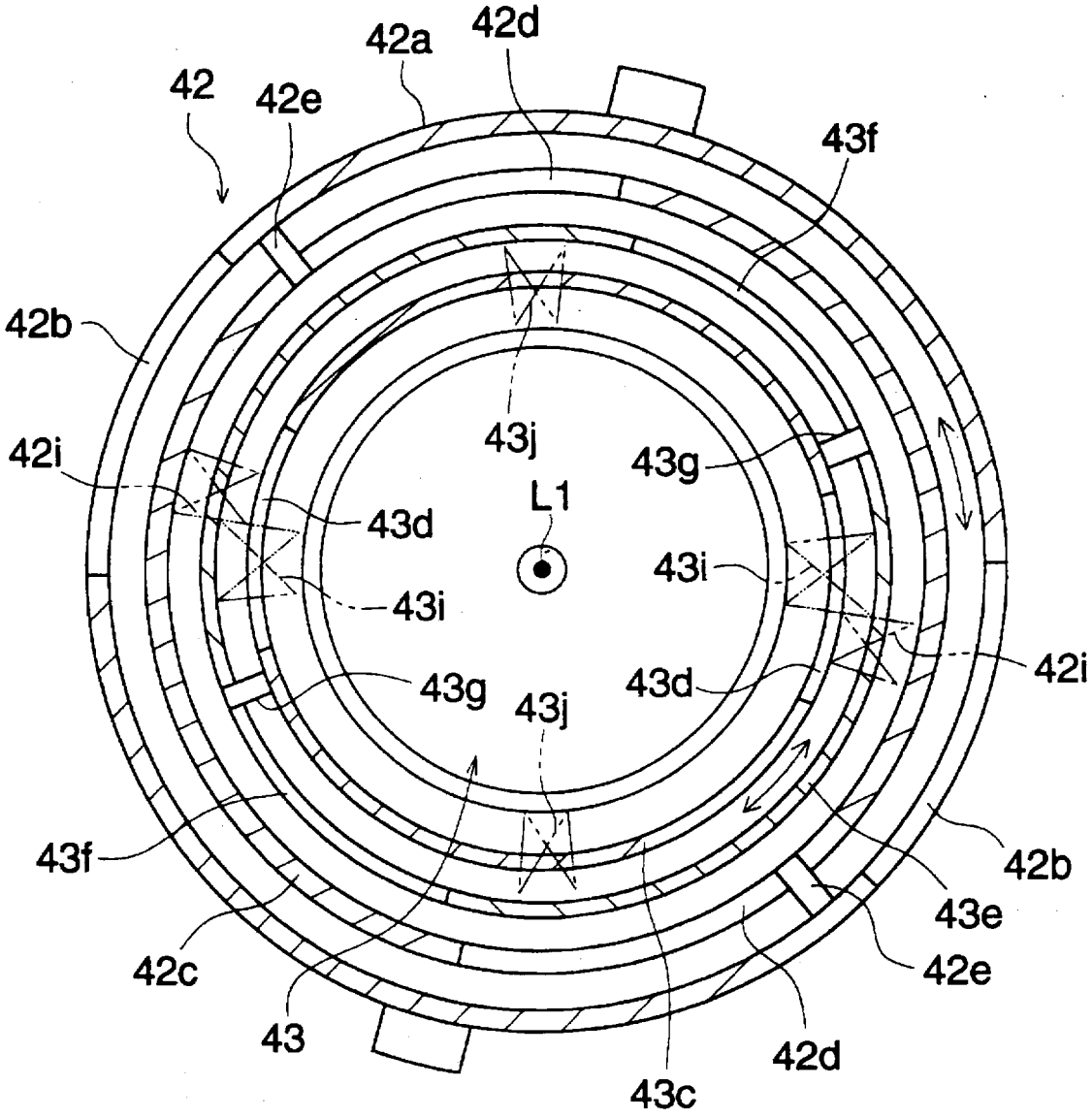
FIG. 10 is a sectional view showing a mounted condition of the developer cartridge and the developer cartridge holder.

That is, as shown in FIGS. 9 and 10, a cartridge developer supply portion 42*a* is formed in the developer cartridge 42, and a cartridge developer supply port 42*b* is formed in the cartridge developer supply portion 42*a*. A cartridge opening/closing cap portion 42*c*, which opens and closes the cartridge developer supply port 42*b*, is provided in the cartridge developer supply portion 42*a* such that it can be rotated around a rotational central axis L1 of the developer cartridge 42. An opening 42*d*, which is communicated to the cartridge developer supply port 42*b*, is provided in the cartridge opening/closing cap portion 42*c*.

A stopper rib 42*e* is provided in the cartridge developer supply portion 42*a*, and the stopper rib 42*e* is positioned facing the opening portion 42*d*. The cartridge opening/closing cap portion 42*c* is rotated within the range in which stopper rib 42*e* comes into contact with both sides of the opening portion 42*d*, and thereby opens or closes the cartridge developer supply port 42*b*. When the cartridge developer supply port 42*b* is communicated to the opening portion 42*d*, the cartridge developer supply port 42*b* is in the "opened" status, and when the cartridge developer supply port 42*b* is not communicated to the opening portion 42*d*, the cartridge developer supply port 42*b* is in the "closed" status. An engagement portion 42*i* to rotate the cartridge opening/closing cap portion 42 in the surface perpendicular to the rotational central axis L1 of the developer cartridge 42 is integrally formed on the cartridge opening/closing cap portion 42*c*.

When the developer cartridge 42 is rotated over the range of the opening portion 42*d*, the developer cartridge 42 is integrally rotated with the cartridge opening/closing cap portion 42*c* by the stopper rib 42*e*.

On the other hand, a cartridge holder developer supply portion 43*c* is formed in the developer cartridge holder portion 43, and a cartridge holder portion developer supply port 43*d* is formed in the cartridge holder developer supply portion 43*c*. In the cartridge holder developer supply portion 43*c*, a cartridge holder opening/closing cap portion 43*e*, which opens or closes the cartridge holder portion developer supply port 43*d*, is provided so that it can be rotated around the rotational central axis L1 of the developer cartridge 42. In the cartridge holder opening/closing cap portion 43*e*, an opening 43*f* is provided which is communicated to the cartridge holder portion developer supply opening 43*d*. A stopper rib 43*g* is provided in the cartridge holder developer supply portion 43*c*, and the stopper rib 43*g* is positioned facing the opening portion 43*f*. The cartridge holder opening/closing cap portion 43*e* is rotated within the range in which stopper rib 43*g* comes into contact with both sides of the opening portion 43*f*, and opens or closes the cartridge holder portion developer supply port 43*d*. When the cartridge holder portion developer supply port 43*d* is communicated to the opening portion 43*f*, the developer cartridge holder portion developer supply port 43*d* is in the "opened" status, and when the cartridge holder portion developer supply port 43*d* is not communicated to the opening portion 43*f*, the developer cartridge holder portion developer supply port 43*d* is in the "closed" status. An engagement portion 43*i* to rotate the cartridge holder opening/closing cap portion 43*e* in the surface, which is perpendicular to the rotational central axis L1 of the developer cartridge 42, is also integrally formed on the cartridge holder opening/closing cap portion 43*e*. The engagement portion 43*i* and the engagement portion 42*i* of the cartridge opening/closing cap portion 42*c* are engaged with each other, and are integrally rotated.

Figure 11:
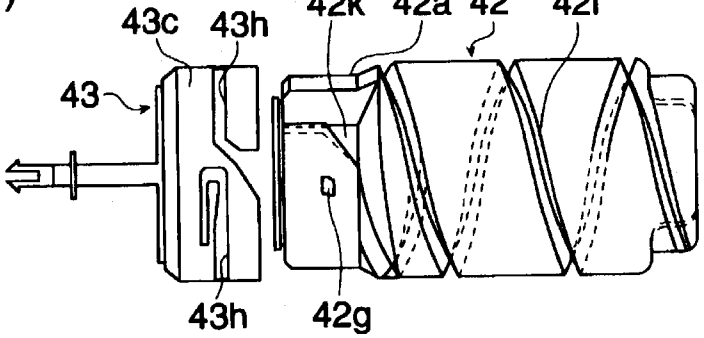
FIGS. 11(*a*) through 11(*f*) are views showing a condition in which the developer cartridge is mounted into the developer cartridge holder.
Figure 11:
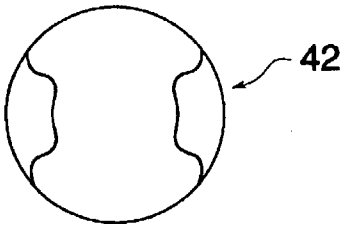
Figure 11:
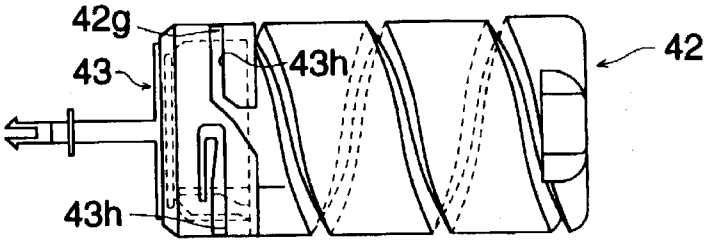
Figure 11:
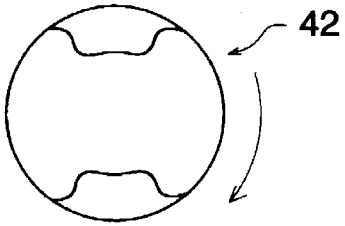
Figure 11:
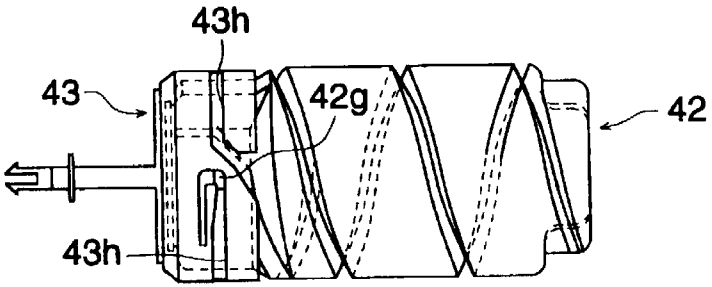
Figure 11:
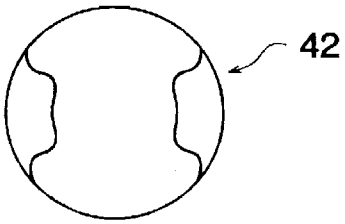
Figure 12:
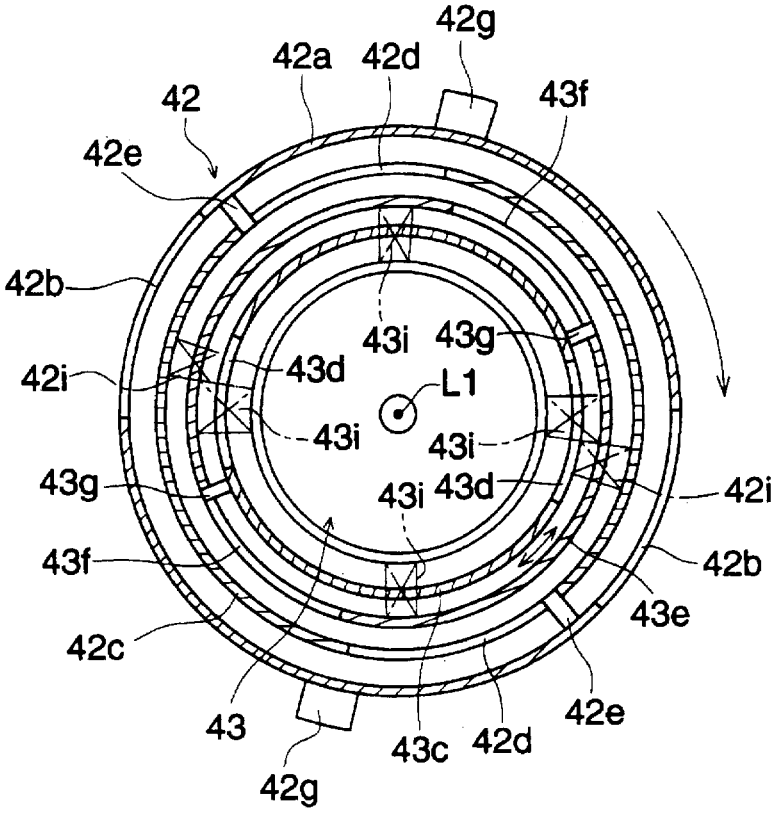
FIGS. 12(*a*) and 12(*b*) are sectional views showing a condition in which the developer cartridge is mounted into the developer cartridge holder.
Figure 12:
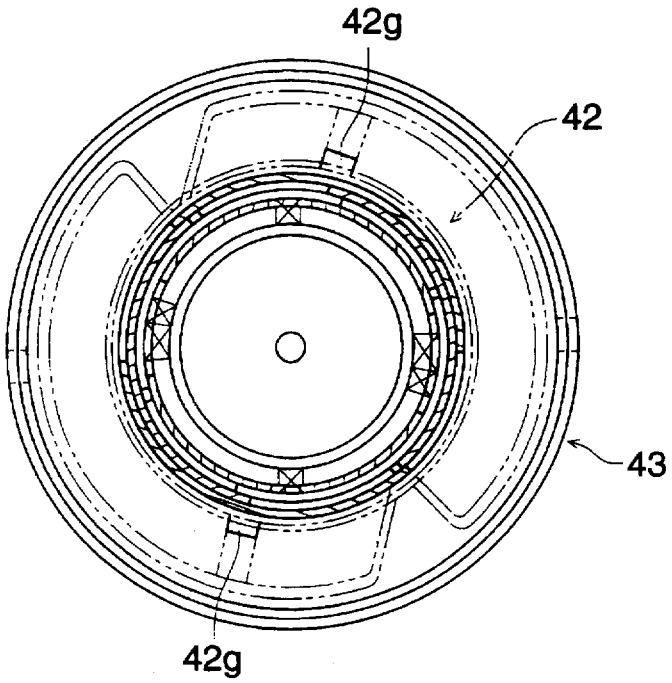

As shown in FIGS. 9 and 11, in the cartridge developer supply portion 42*a* of the developer cartridge 42, a guiding-recess portion 42*k* is formed which guides the interior developer to the cartridge developer supply port 42*b* by rotation. The guiding-recess 42*k* is integrally connected to a spiral guide 42*f* which is formed inside the cartridge. A protrusion 42*g* to engage with the developer cartridge holder portion 43, is integrally formed in the cartridge developer supply portion 42*a*.

On the other hand, an engagement cut-out groove 43*h* which engages with the protrusion 42*g* of the developer cartridge 42 is integrally formed in the cartridge holder developer supply portion 43*c* of the developer cartridge holder 43.

As described above, and as shown in FIGS. 11 and 12, the cartridge developer supply port 42*b* and the cartridge holder portion developer supply port 43*d* are structured such that these ports are opened and closed by attachment and detachment of the developer cartridge 42 to the developer cartridge holder portion 43 while the developer cartridge is being rotated.

As shown in FIGS. 11(*a*) and 11(*b*), when the developer cartridge 42 is attached into the developer cartridge holder portion 43, initially, the protrusion 42*g* of the developer cartridge 42 is engaged with the engagement cut-out groove 43*h* of the developer cartridge holder portion 43. Then, when the developer cartridge 42 is further rotated in the arrowed direction in FIGS. 11(*c*) and 11(*d*), the protrusion 42*g* is rotated along the engagement cut-out groove 43*h*, and finally, as shown in FIGS. 11(*e*) and 11(*f*), the developer cartridge 42 is attached into the developer cartridge holder portion 43.

As shown in FIGS. 12 through 15, when the developer cartridge 42 is attached into the developer cartridge holder portion 43 while being rotated, the cartridge developer supply port 42*b* and the cartridge holder portion developer supply port 43*d* are both opened and developer can be supplied.

Figure 13:
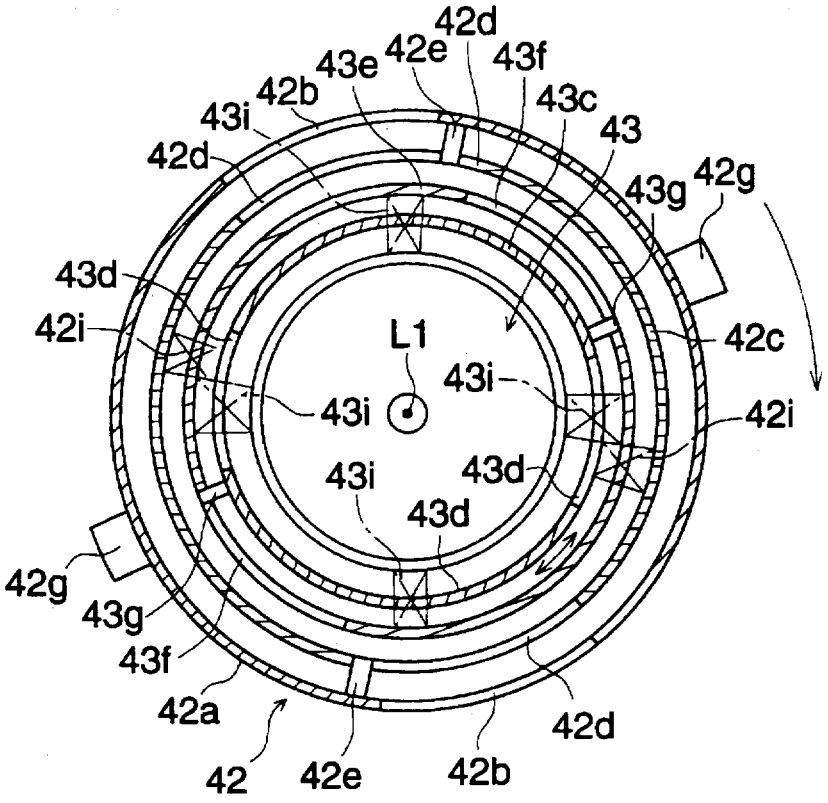
FIGS. 13(*a*) and 13(*b*) are sectional views showing a condition in which the developer cartridge is mounted into the developer cartridge holder.
Figure 13:
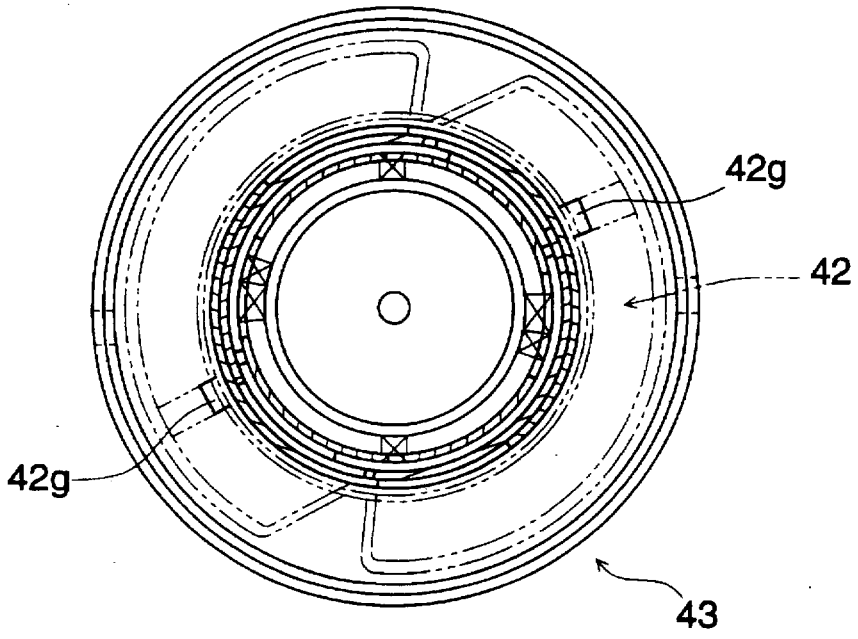
Figure 14:
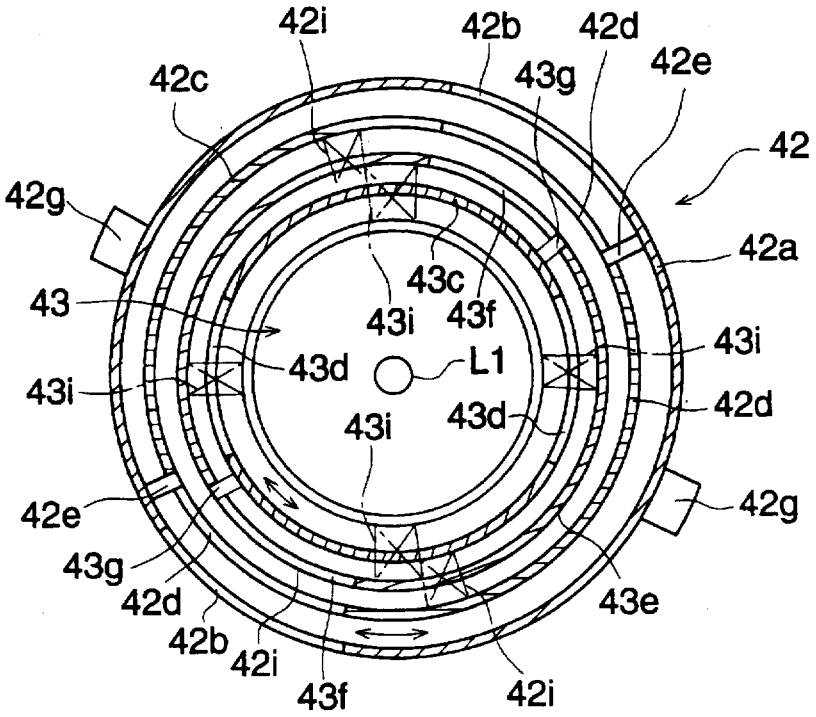
FIGS. 14(*a*) and 14(*b*) are sectional views showing a condition in which the developer cartridge is mounted into the developer cartridge holder.
Figure 14:
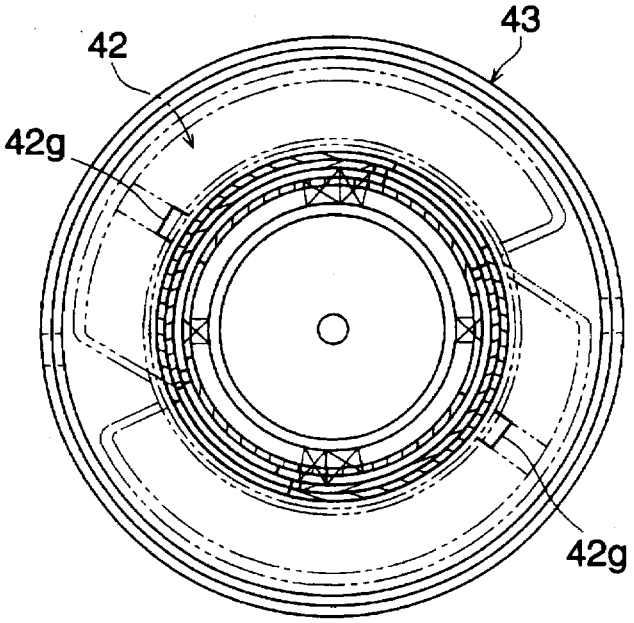

That is, when the cartridge developer supply portion 42*a* of the developer cartridge 42 is engaged with the cartridge holder developer supply portion 43*c* of the developer cartridge holder portion 43, and the developer cartridge 42 is rotated in the arrowed direction, the cartridge developer supply port 42*b* of the developer cartridge 42 is communicated to the opening portion 42*d* of the cartridge opening/closing cap portion 42*c* as shown in FIG. 13. Further, when the developer cartridge 42 is rotated in the arrowed direction, the cartridge opening/closing cap portion 42*c* is rotated by the stopper rib 42*e*, and as shown in FIG. 14, the cartridge developer supply port 42*b*, opening portion 42*d*, and the opening portion 43*f* of the cartridge holder opening/closing cap portion 43*e* are communicated to each other. Further, when the developer cartridge 42 is rotated in the arrowed direction, the cartridge holder opening/closing cap portion 43*e* is also rotated, and as shown in FIG. 15, the cartridge developer supply port 42*b*, the opening portion 42*d* of the cartridge opening/closing cap portion 42*c*, the opening portion 43*f* of the cartridge holder opening/closing cap portion 43*e*, and the cartridge holder portion developer supply port 43*d* are communicated to each other.

In the case where the developer cartridge 42 is detached from the developer cartridge holder portion 43, when the developer cartridge 42 is rotated in the reverse direction to the above description, then, the cartridge developer supply port 42*b*, the opening portion 42*d* of the cartridge opening/closing cap portion 42*c*, the opening portion 43*f* of the cartridge holder opening/closing cap portion 43*e*, and the cartridge holder portion developer supply port 43*d* are all shielded.

As described above, when the cartridge opening/closing cap portion 42*c* having the first developer supply port 42*b*, and the cartridge holder opening/closing cap portion 43*c* having the cartridge holder portion developer supply port 43*d*, are attached to and detached from the developer cartridge holder portion 43 while the developer cartridge 42 is being rotated, these cap portions are rotated and opened/closed, wherein the first developer supply port 42*b* and the cartridge holder portion developer supply port 43*d* face each other with respect to the rotational central axis L1 of the developer cartridge 42. Therefore, the developer supply port of the developer cartridge 42 can be securely opened and closed by a simple structure. Further, when the developer supply ports are provided to face each other with respect to the rotational central axis L1 of the developer cartridge 42, developer can be smoothly supplied radially from the circumference of the developer cartridge 42.

Figure 16:
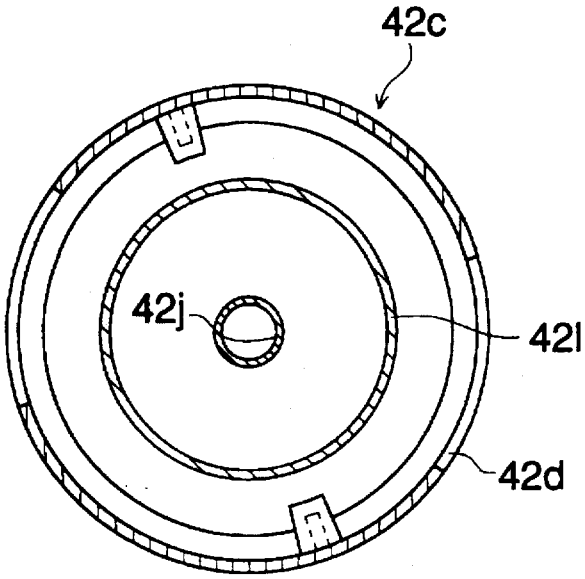
FIG. 16(*a*) and 16(*b*) are views showing the first opening/closing cover of a yellow developer cartridge.
Figure 16:
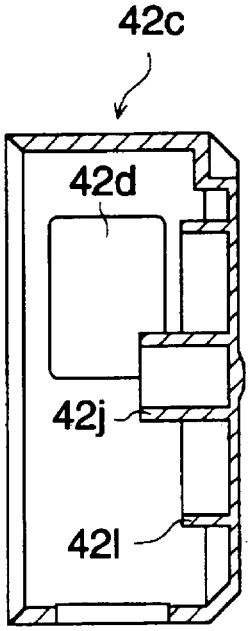
Figure 17:
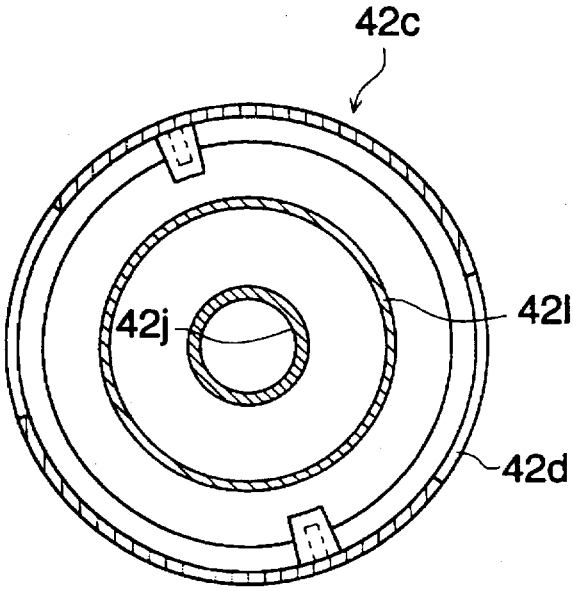
FIGS. 17(*a*) and 17(*b*) are views showing the first opening/closing cover of a magenta developer cartridge.
Figure 17:
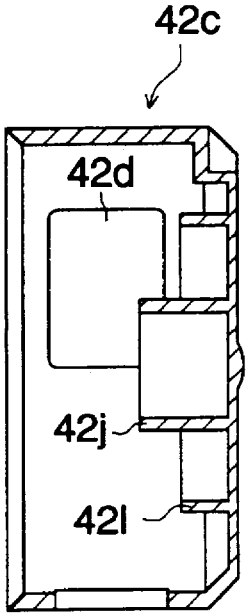
Figure 18:
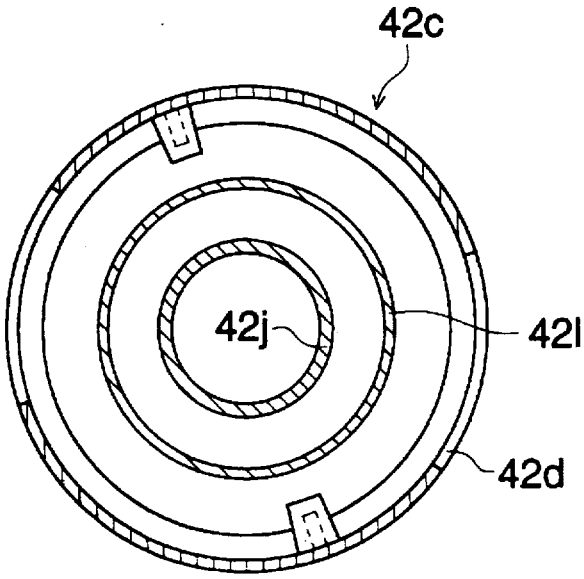
FIGS. 18(*a*) and 18(*b*) are views showing the first opening/closing cover of a cyan developer cartridge.
Figure 18:
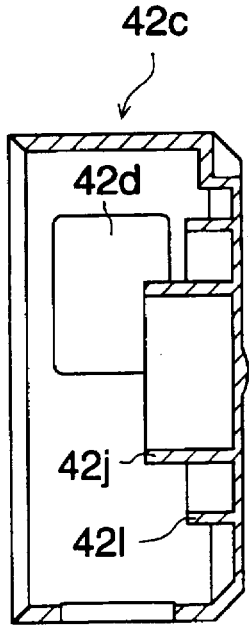
Figure 19:
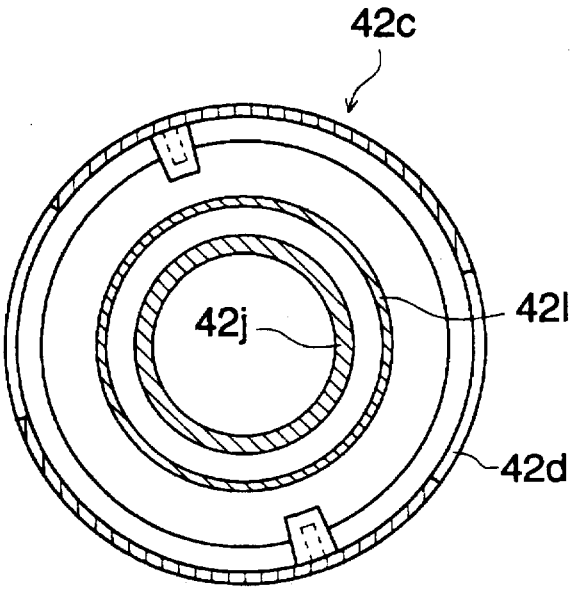
FIGS. 19(*a*) and 19(*b*) are views showing the first opening/closing cover of a black developer cartridge.
Figure 19:
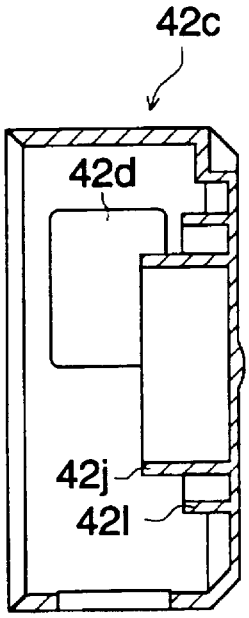

As shown in FIGS. 16 through 19, the cartridge opening/closing cap portion 42*c* of each of the 4-color developer cartridges 42 is structured such that the radius of the protruded portions 42*j* and 42*l*, formed on the inner wall of each of the cartridge opening/closing cap portion 42*c* of the yellow developer cartridge 42 shown in FIG. 16, the magenta developer cartridge 42 shown in FIG. 17, the cyan developer cartridge 42 shown in FIG. 18, and the black developer cartridge 42 shown in FIG. 19, are different from each of the other developer cartridges. Recess portions which can be engaged with the corresponding protruding portions 42*j* and 42*l*, are formed on the cartridge holder opening/closing cap portion 43*e* of the developer cartridge holder portion 43, and thereby, none of the 4-color developer cartridges 42 can be erroneously attached into the developer cartridge holder portion 43.

Herein, the engagement of the developer cartridge 42 with the developer cartridge holder portion 43 will be further detailed below. In FIG. 8(*a*), a supply guide 43*a* is integrally formed near the supply port 43*d*, on the side of the developer cartridge holder portion 43 opposed to the developer cartridge 42. The supply guide 43*a* is composed of a developer dipping-up surface portion and an inclined surface portion. A shaft portion 43*b* is integrally formed on the other tip of the developer cartridge holder portion 43, and a driven gear 46 is engaged with the protruded tip. The driven gear 46 and the shaft portion 43*b* are approximately horizontally supported by support walls 40A, 40B, 40C, and a support member 40D of the developer supply apparatus 40.

The driving force of the drive source of the image forming apparatus is transmitted through an intermediate gear train and the driven gear 46, which will be described later, and thereby, the developer cartridge holder portion 43, integrally formed with the shaft portion 43*b* which is engaged with the driven gear 46, is rotated. Further, the developer cartridge 42 engaged with the developer cartridge holder portion 43, is also simultaneously rotated integrally. Due to this rotation, developer T in the developer cartridge 42 is propelled in the direction of opening portion 425 by the spiral protrusion 424, as shown in FIG. 9, further dipped up by a guide recessed portion (developer sending portion) 42*k*, passed through supply ports 42*b* and 42*d* which have been rotated upward, and fed to the developer cartridge holder portion 43. Developer T sent to the developer cartridge holder portion 43 which is rotated integrally with the developer cartridge 42, is dipped up by the developer dipping-up surface portion, and is delivered, as shown by an arrow in FIG. 8(*a*), when the supply ports 42*b* and 42*d* of the developer cartridge 42, and the supply ports 43*d* and 43*f* of the developer cartridge holder portion 43 almost reach the upper-most position. Then, developer T is supplied to the developer container portion 41 (developer hopper). The amount of developer T accommodated in the developer container portion 41 is detected by an optical detecting means, which is not shown in the drawing. When the developer supply amount reaches a predetermined value, drive of the driving source is stopped, and subsequently the developer supply from the developer cartridge 42 is stopped.

FIGS. 8(*b*) and 8(*c*) are respectively a rear view and a sectional view showing the rotation process of the developer cartridge holder portion 43. The developer container portion 41 is provided with a developer residual amount detection. sensor. When the developer residual amount detection sensor detects an insufficient developer amount in the developer container portion 41, the driven gear 46 is caused to rotate by the detection signal, and thereby, the developer cartridge holder portion 43 and the developer cartridge 42 are rotated counterclockwise as shown in the drawing. Due to the rotation of the developer cartridge 42, the developer T delivered from the supply ports 43*d* and 43*f* by thrusting force of the spiral protrusion 424, is dipped up by the dipping-up surface portion which is rotated together with the developer cartridge holder portion 43 in the arrowed direction. When the developer T reaches in the vicinity of the rotational upper position above the shaft portion 43*b* as shown in FIG. 8(*c*), the developer falls and slides along the inclined surface portion, and is accommodated in the developer container portion 41 which is located below the shaft portion 43*b*.

When a decrease of developer in the developing devices 33 is detected by the detection means, a conveyance screw 441 of a developer conveyance means 44, shown in FIG. 8(*a*), is rotated, and the developer T temporarily accommodated in the developer container portion 41 is conveyed in the appropriately horizontal direction. The developer T is supplied from the arrowed portion in FIG. 8(*a*) to the developing devices 33 located below. The conveyance screw 441 is housed in a developer conveyance path 443, formed between a cartridge holding casing (the second casing) 440 located in the lower portion, and a cartridge supporting member (a container supporting member) 442 located in the upper portion, and is connected to the driving source, not shown in the drawing, and rotatable. The second casing 440 and the container supporting member 442 are closely connected to each other so that the developer does not leak. However, these can be separated and re-assembled after the developer conveyance path 443 and the conveyance screw 441 have been inspected and repaired.

As described above, the developer T is supplied from the upper portion of the developer cartridge 42 to the developer container portion, and therefore, the developer cartridge 42 and the developer container portion 41 are arranged in approximately the same plane, the total height of the apparatus can be reduced, and the overall apparatus can be more compact.

Further, as shown in FIG. (8*a*), the supply guide 43*a*, by which supply ports 42*b* and 42*d* of the developer cartridge 42 and the supply ports 43*d* and 43*f* of the developer container portion (toner hopper) 41 are connected to each other, is located above the rotation shaft of the developer cartridge 42, and thereby, a sufficient amount of developer can be secured in the developer container portion 41. Accordingly, even when the developer in the developer cartridge 42 is exhausted, and image formation is continuously carried out during replacement of the developer cartridge 42 by the operator, a decrease of the image density does not immediately occur.

Figure 20:
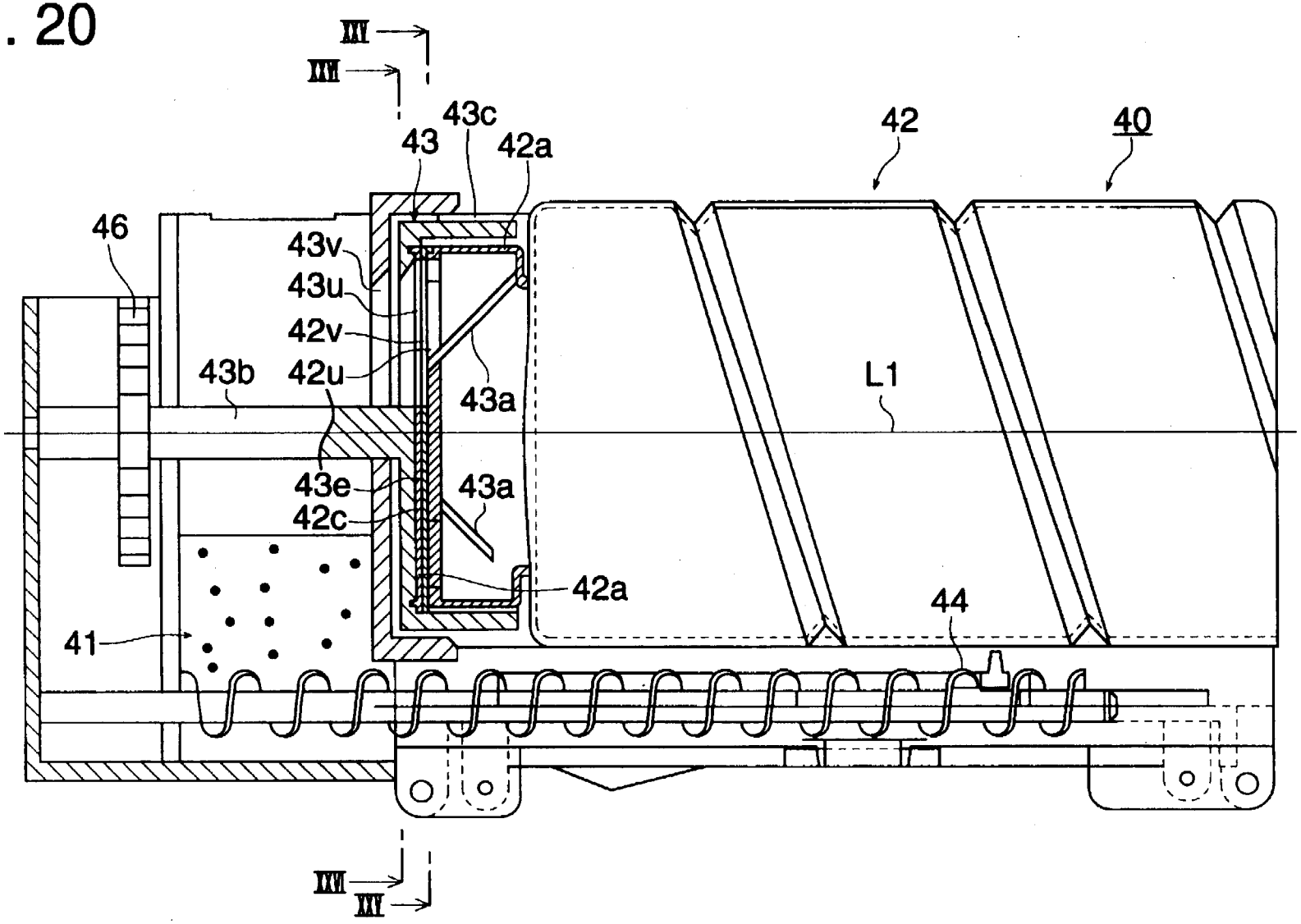
FIG. 20 is a sectional view showing a mounting condition of the developer cartridge and the developer cartridge holder.
Figure 21:
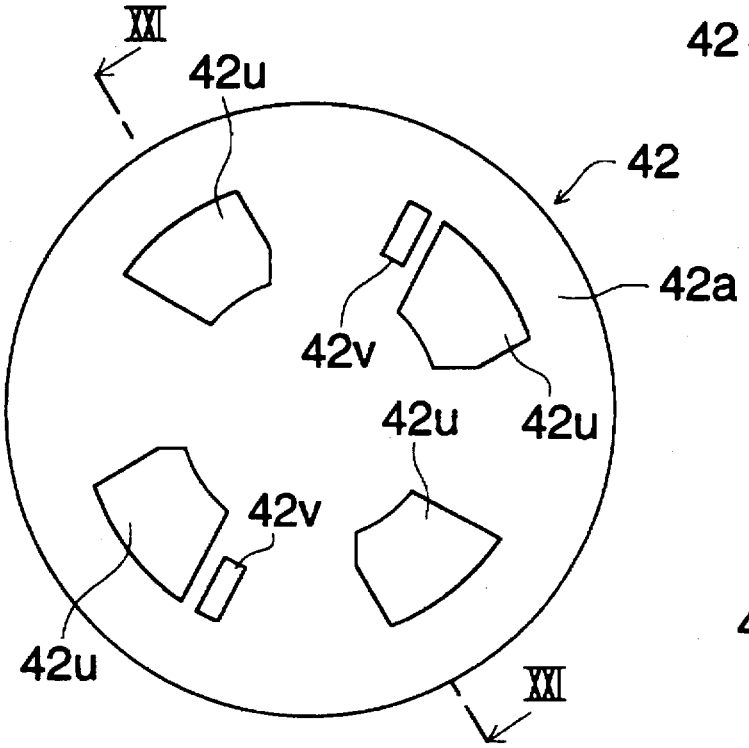
FIGS. 21(*a*) and 21(*b*) are views showing the developer cartridge.
Figure 21:
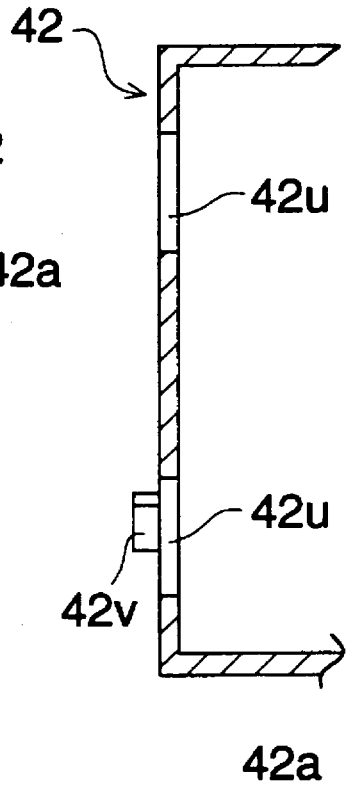
Figure 22:
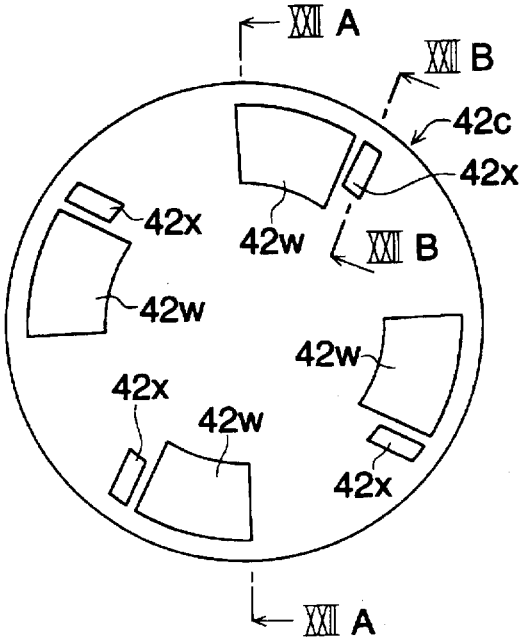
FIGS. 22(*a*) through 22(*c*) are views showing a cartridge opening/closing cover portion.
Figure 22:
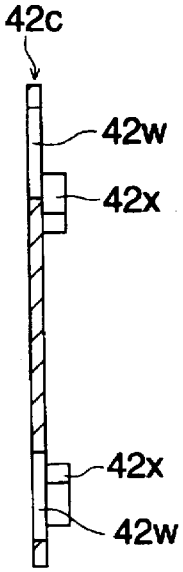
Figure 22:
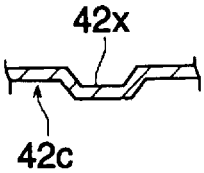
Figure 23:
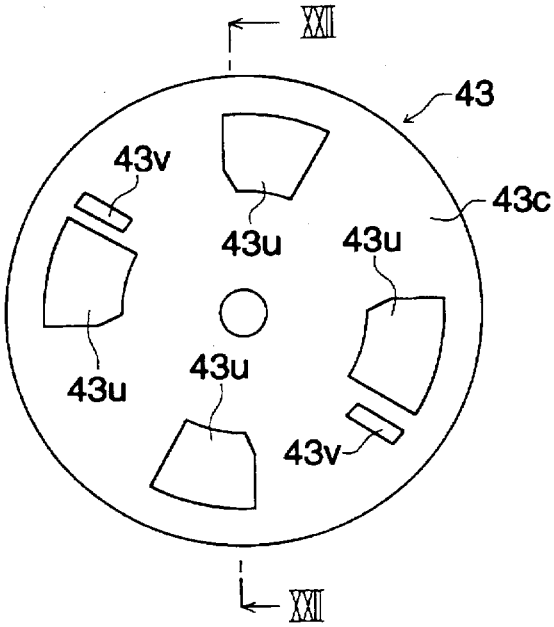
FIGS. 23(*a*) and 23(*b*) are views showing the developer cartridge holder.
Figure 23:
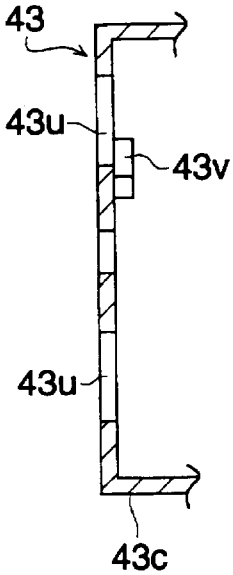
Figure 24:
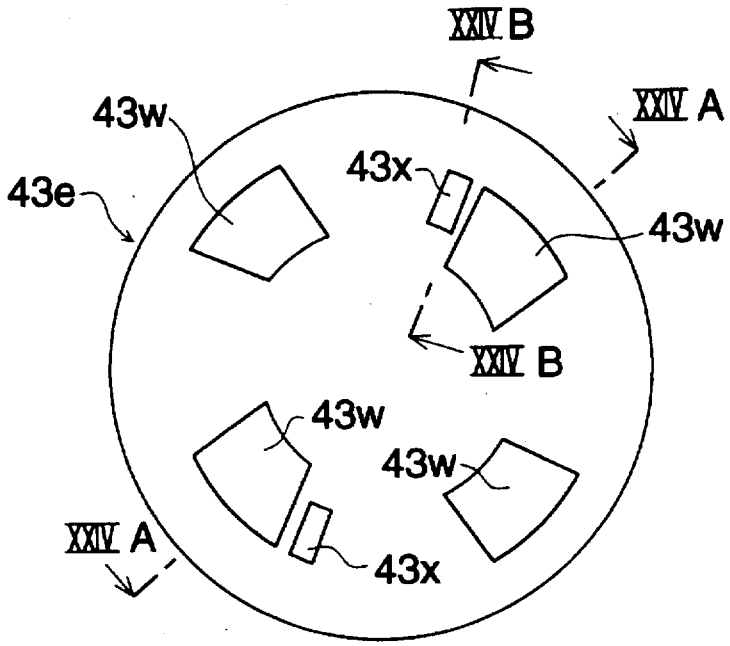
FIGS. 24(*a*) through 24(*c*) are views showing a cartridge holder opening/closing cover portion.
Figure 24:
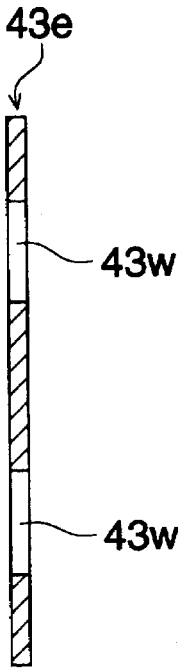
Figure 24:
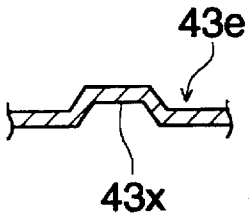
Figure 25:
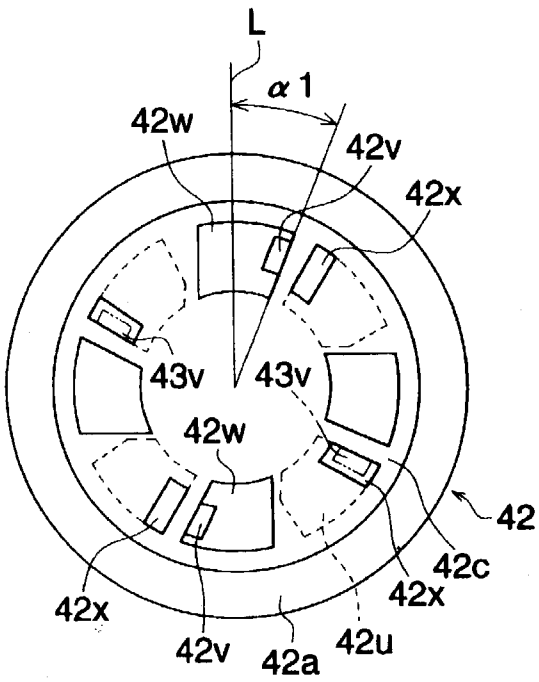
FIGS. 25(*a*) through 25(*c*) are views showing the developer cartridge and an opening/closing condition of the cartridge opening/closing cover portion along XXV—XXV in FIG. 20.
Figure 25:
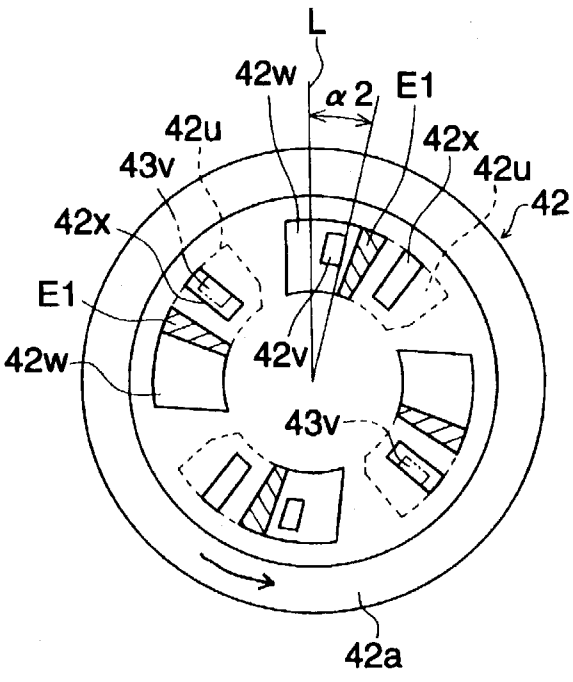
Figure 25:
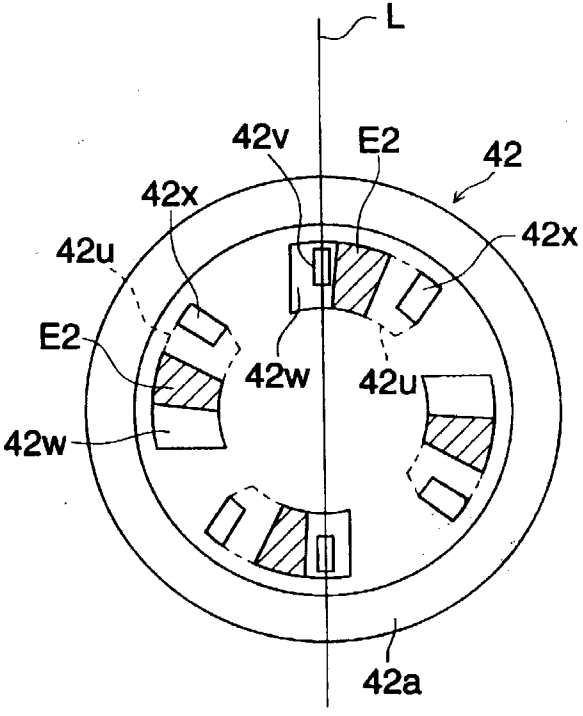
Figure 26:
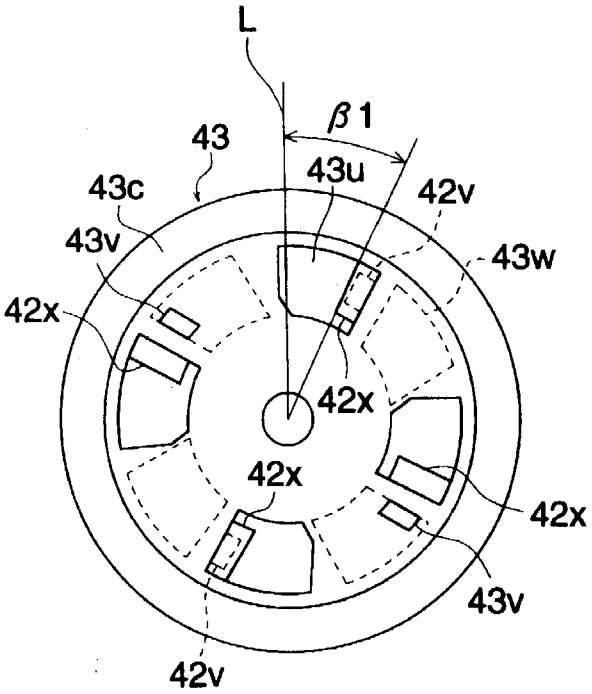
FIGS. 26(*a*) through 26(*c*) are views showing a developer supplying portion of the cartridge holder and an opening/closing condition of the cartridge holder opening/closing cover portion along XXVI—XXVI in FIG. 20.
Figure 26:
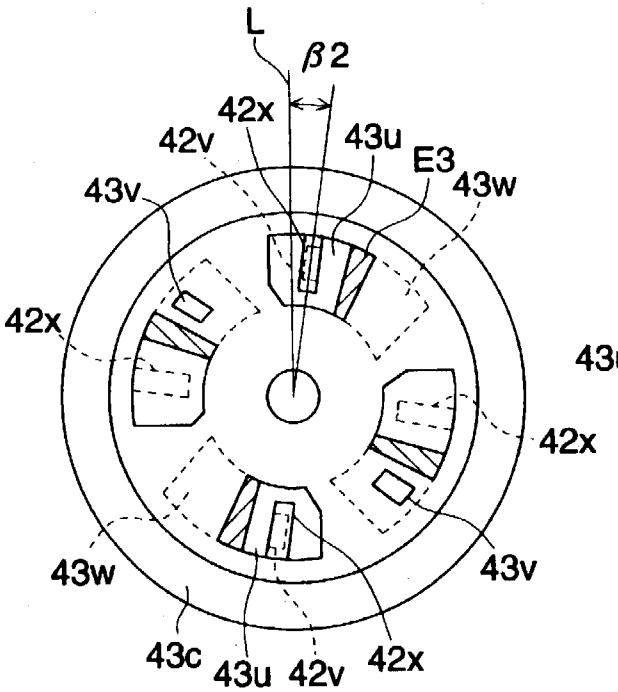
Figure 26:
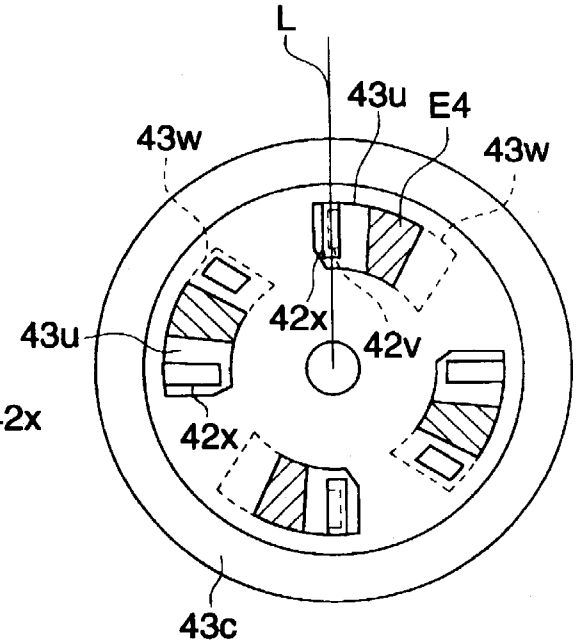

Referring to FIGS. 20 through 24, another example of the image forming apparatus shown in FIGS. 1 through 19, will be described below. FIG. 20 is a sectional view showing a condition of the developer cartridge attached to the developer cartridge holder portion. FIG. 21 is a view showing the developer cartridge. FIG. 22 is a view showing the cartridge opening/closing cap portion. FIG. 23 is a view showing the developer cartridge holder portion. FIG. 24 is a view showing the cartridge holder opening/closing cap portion. FIG. 25 is a view showing the developer cartridge and an opening/closing state of the cartridge opening/closing cap portion, along XXV—XXV in FIG. 20. FIG. 26 is a view showing the cartridge holder developer supply portion and the opening/closing state of the cartridge holder opening/closing cap portion, along XXVI—XXVI in FIG. 20.

In the present example, the same members as in the above-described example, are denoted by the same numerals, and explanations for these members are omitted. A developer supply port opening/closing means to open and close the developer supply port by attaching or detaching the developer cartridge 42 to or from the developer cartridge holder portion 43 of the present example, while the developer cartridge 42 is being rotated, is provided in the developer cartridge holder portion 43, and the developer supply ports, which face each other, are provided in the direction perpendicular to the rotational central axis L1 of the developer cartridge 42.

The developer cartridge 42 is shown in FIG. 21. FIG. 21(*a*) is a front view of the cartridge developer supply portion 42*a* of the developer cartridge 42, while FIG. 21(*b*) is a sectional view along XXI—XXI of FIG. 21(*a*). The cartridge developer supply portion 42*a* is formed on the developer cartridge 42. In the cartridge developer supply portion 42*a*, four cartridge developer supply ports 42*u* are formed in the surface perpendicular to the rotational central axis L1 of the developer cartridge 42 at predetermined equal intervals. Further, two cartridge protrusions 42*v* are formed in the vicinity of the cartridge developer supply ports 42*u* on the vertical surface of the cartridge developer supply portion 42*a*.

A plate-like cartridge opening/closing cap portion 42*c*, to open and close the cartridge developer supply port 42*u*, is rotatably provided in the direction of the vertical surface with respect to the rotational central axis L1 of the developer cartridge 42 in the cartridge developer supply portion 42*a*, and the cartridge opening/closing cap portion 42*c* is shown in FIG. 22. FIG. 22(*a*) is a plan view of the cartridge opening/closing cap portion 42*c*, FIG. 22(*b*) is a sectional view along XXIIA—XXIIA in FIG. 22, and FIG. 22(*c*) is a sectional view along XXIIB—XXIIB in FIG. 22.

In the cartridge opening/closing cap portion 42*c*, four opening portions 42*w* which are communicated to the cartridge developer supply ports 42*u*, are provided with equal intervals. Further, four cartridge opening/closing cap groove portions 42*x* are provided in the vicinity of the opening portions 42*w*.

The cartridge opening/closing cap portion 42*c* is assembled by being superimposed on the cartridge developer supply portion 42*a*. The cartridge protrusion 42*v* of the cartridge developer supply portion 42*a* is positioned in the opening portion 42*w* of the cartridge opening/closing cap portion 42*c*, while the cartridge opening/closing cap groove portion 42*x* of the cartridge opening/closing cap portion 42*c* is positioned in the cartridge developer supply ports 42*u* of the cartridge developer supply portion 42*a*.

The cartridge protrusion 42*v* of the cartridge developer supply portion 42*a* regulates the rotation within the range of the opening portion 42*w* of the cartridge opening/closing cap portion 42*c*. The cartridge opening/closing cap portion 42*c* can rotate only within the range in which the cartridge protrusion 42*v* comes into contact with both sides of the opening portion 42*w*, and opens and closes the cartridge developer supply port 42*u*. When the cartridge developer supply port 42*u* is communicated to the opening portion 42*w*, the developer cartridge 42 is in the opened status, and when the cartridge developer supply port 42*u* is not communicated to the opening portion 42*w*, the developer cartridge 42 is in the closed status.

The developer cartridge holder portion 43 is structured as shown in FIG. 23. FIG. 23(*a*) is a front view of the developer cartridge holder portion 43, while FIG. 23(*b*) is a sectional view along XXIII—XXIII in FIG. 23(*a*). The cartridge holder developer supply portion 43*c* is formed in the developer cartridge holder portion 43. In the cartridge holder developer supply portion 43*c*, four cartridge holder portion developer supply ports 43*u* are formed, with the same intervals, in the surface perpendicular to the rotational central shaft L1 of the developer cartridge 42, and the cartridge holder portion protrusions 43*v* are formed. The cartridge holder opening/closing cap portion 43*e* is provided in the developer cartridge holder portion 43.

The cartridge holder opening/closing cap portion 43*e* is shown in FIG. 24. FIG. 24(*a*) is a front view of the cartridge holder opening/closing cap portion 43*e*, FIG. 24(*b*) is a sectional view along XXIVA—XXIVA in FIG. 24(*a*), and FIG. 24(*c*) is a sectional view along XXIVB—XXIVB in FIG. 24(*a*). In the cartridge holder opening/closing cap portion 43*e*, opening portions 43*w* are formed, and further, the cartridge holder opening/closing cap groove portion 43*x* is formed.

The cartridge holder opening/closing cap portion 43*e* is assembled by being superimposed on the cartridge holder developer supply portion 43*c* of the developer cartridge holder portion 43, and is rotatably provided in the surface perpendicular to the rotational central axis L1 of the developer cartridge 42, in the cartridge holder developer supply portion 43*c* of the developer cartridge holder portion 43. Cartridge holder portion protrusions 43*v* of the cartridge holder developer supply portion 43*c* are positioned in the opening portion 43*w* of the cartridge holder opening/closing cap portion 43*e*, and the cartridge protrusions 42*v* of the cartridge developer supply portion 42*a* are positioned in the cartridge holder opening/closing cap groove portions 43*x* of the cartridge holder opening/closing cap portion 43*e*.

The cartridge holder portion protrusions 43*v* of the cartridge holder developer supply portion 43*c* regulate the rotation within the range of the opening portion 43*w* of the cartridge holder opening/closing cap portion 43*e*. The cartridge holder opening/closing cap portion 43*e* is limited to rotate within the range in which the cartridge holder portion protrusions 43*v* come into contact with either side of the opening portions 43*w*, and thereby opens and closes the cartridge holder portion developer supply ports 43*u*. When the cartridge holder portion developer supply ports 43*u* are communicated to the opening portions 43*w*, the cartridge holder portion developer supply ports 43u are in the opened status, while when the cartridge developer supply ports 42u are not communicated to the opening portions 43w, the cartridge developer supply ports 42u are in the closed status.

Accordingly, as shown in FIG. 25(*a*), when the cartridge developer supply portion 42a is positioned at a predetermined angle of $\alpha_1$ with respect to the cartridge opening/closing cap portion 42c, the opening portions 42w are not communicated to the cartridge developer supply ports 42u, and then cartridge developer supply ports 42u are in the closed status. In this case, when the cartridge holder opening/closing cap portion 43e *is* not rotated, the cartridge holder developer supply portion 43c and cartridge holder opening/closing cap portion 43e, of the developer cartridge holder portion 43, are positioned at a predetermined angle of $\beta_1$, as shown in FIG. 26(*a*), and the opening portions 43w are not communicated to the cartridge holder portion developer supply ports 43u, and then the cartridge holder portion developer supply ports 43u are in the closed status.

The developer cartridge 42 is rotated in the arrowed direction, and as shown in FIG. 25(*b*), when the cartridge developer supply portion 42a is positioned at a predetermined angle $\alpha_2$ with respect to the cartridge opening/closing cap portion 42c, the cartridge developer supply ports 42u are communicated to the opening portions 42w in the range E1, partially shown by slanting lines. In this case, as shown in FIG. 26(*b*), the cartridge holder opening/closing cap portion 43e is rotated by the cartridge protrusions 42v of the cartridge developer supply portion 42a, and is positioned at a predetermined angle of $\beta_2$ with respect to the cartridge holder developer supply portion 43c. Then, the cartridge holder portion developer supply ports 43u are communicated to the opening portions 43w in the range E3, partially shown by slanting lines. The range E3 which is partially shown by slanting lines, coincides with the range E1, partially shown by slanting lines, in which state the cartridge developer supply ports 42u are communicated to the opening portions 42w.

When the developer cartridge 42 is further rotated, and as shown in FIG. 25(*c*), the cartridge developer supply portion 42a is located at a predetermined position with respect to the cartridge opening/closing cap portion 42c, and then, the cartridge developer supply ports 42u are communicated to the opening portions 42w within the range E2 shown by slanting lines. In this case, as shown in FIG. 26(*c*), the cartridge holder opening/closing cap portion 43e is further rotated by the cartridge protrusions 42v of the cartridge developer supply portion 43e, the cartridge holder opening/closing cap portion 43e is located at a predetermined position with respect to the cartridge holder developer supply portion 43c, and the opening positions 43w are communicated to the cartridge holder portion developer supply ports 43u within the range E3, partially shown by slanting lines. The range E4 shown by slanting lines, coincides with the range E2, shown by slanting lines, in which the opening portions 42w are communicated to the cartridge developer supply ports 42u.

As described above, the cartridge developer supply ports 42b and the cartridge holder portion developer supply ports 43d are structured such that these supply ports are opened and closed when the developer cartridge 42 is attached to the developer cartridge holder portion 43 while being rotated.

When the developer cartridge 42 is attached to the developer cartridge holder portion 43 while being rotated, the cartridge developer supply ports 42u and the cartridge holder portion developer supply ports 43u are opened, and developer can be supplied. Thus, the cartridge opening/closing cap portion 42c having the cartridge developer supply ports 42u, and the cartridge holder opening/closing cap portion 43e having the cartridge holder portion developer supply ports 43u, in which these supply ports are opposed to each other in the surface perpendicular to the rotational central axis L1 of the developer cartridge 42, are opened and closed when the developer cartridge 42 is attached to or detached from the developer cartridge holder portion 43 while being rotated. Thereby, the developer supply ports of the developer cartridge 42 can be securely opened and closed by a simple structure. Further, when the developer supply ports are provided such that the supply ports are opposed to each other in the surface perpendicular to the rotational central axis of the developer cartridge 42, the developer can be smoothly supplied via the direction of the rotational central axis of the developer cartridge 42.

What is claimed is:

1. A developer cartridge, capable of being attached to and detached from an image forming apparatus, comprising:

a) a cartridge main body having a shape for moving said developer toward a developer supply port when said cartridge main body is rotated around a rotation axis;

b) said developer supply port for supplying said developer to said image forming apparatus; and c) an opening/closing covering member for opening said developer supply port;

wherein said opening/closing covering member includes an engagement member for connecting said developer supply port with said opening/closing covering member so that said engagement member positions said opening/closing covering member at an opened state of said developer supply port when said developer cartridge is mounted in said image forming apparatus and said developer cartridge is rotated around said rotation axis.

2. The developer cartridge of claim 1, wherein a direction of the opening/closing motion of said opening/closing covering member of said developer cartridge is structured parallel to said rotation axis.

3. The developer cartridge of claim 2, said developer supply portion of said developer cartridge further includes a guiding-recess portion for guiding said developer toward said developer supply port by rotation of said cartridge main body.

4. The developer cartridge of claim 1, wherein a direction of the opening/closing motion of said opening/closing covering member of said developer cartridge is structured perpendicular to said rotation axis.

5. The developer cartridge of claim 4, further comprises a developer supply portion which includes said developer supply port; wherein said developer supply portion further includes a guiding-recess portion for guiding said developer toward said developer supply port by rotation of said cartridge main body.

6. The developer cartridge of claim 5, wherein said developer supply portion further includes an inclined surface portion for sliding and falling said developer, having been guided to said developer supply port by said guiding-recess portion, to said image forming apparatus.

7. An image forming apparatus comprising:

a developing means for developing an image with developer;

a developer container means for supplying said developer to said developing means;

a developer cartridge, being attachable to and detachable from said developer container means; and a driving means for rotating said developer cartridge; wherein said developer cartridge further includes:

a) a cartridge main body having a shape for moving said developer toward a first developer supply port when said cartridge main body is rotated around a rotation axis by said driving means;

b) said first developer supply port for supplying said developer to said image forming apparatus; and c) a first opening/closing covering member for opening said first developer supply port;

wherein said first opening/closing covering member includes a first engagement member for connecting said first developer supply port with said first opening/closing covering member so that said first engagement member positions said first opening/closing covering member at an opened state of said first developer supply port when said developer cartridge is mounted in said image forming apparatus and said developer cartridge is rotated around said rotation axis.

8. The image forming apparatus of claim 7, wherein said developer container means includes:

a) a second developer supply port for supplying said developer from said first developer supply port to said developer container means; and b) a second opening/closing covering member for opening said second developer supply port;

wherein said second opening/closing covering member includes a second engagement member for connecting said second developer supply port with said second opening/closing covering member so that said second engagement member positions said second opening/closing covering member at an opened state of said second developer supply port when said developer cartridge is mounted in said image forming apparatus and said developer cartridge is rotated around said rotation axis.

9. The image forming apparatus of claim 8, further comprising:

a third engagement member for connecting said developer container means and said developer cartridge so that said third engagement member moves said first opening/closing covering member until said first developer supply port is opened and said second opening/closing covering member until said second developer supply port is opened when said developer cartridge is mounted in said image forming apparatus and said developer cartridge is rotated around said rotation axis.

10. The image forming apparatus of claim 7, further comprising:

a developer cartridge holder means for holding said developer cartridge; wherein said developer cartridge holder means further includes a drive regulation means for stopping rotation of said driving means when said first opening/closing covering member is opened.

11. The image forming apparatus of claim 7, further comprising:

a developer cartridge holder means for holding said developer cartridge; wherein said developer cartridge holder means further includes a supply guide for sliding and falling said developer toward said developer container portion.

12. The image forming apparatus of claim 7, wherein a direction of the opening/closing motion of said first opening/closing covering member of said developer cartridge is structured parallel to said rotation axis.

13. The image forming apparatus of claim 12, wherein said developer cartridge comprises a developer supply portion which includes said first developer supply port; wherein said developer supply portion further includes a guiding-recess portion for guiding said developer toward said first developer supply port by rotation of said cartridge main body.

14. The image forming apparatus of claim 7, wherein a direction of the opening/closing motion of said first opening/closing covering member of said developer cartridge is structured perpendicular to said rotation axis.

15. The image forming apparatus of claim 14, wherein said developer cartridge comprises a developer supply portion which includes said first developer supply port; wherein said developer supply portion further includes a guiding-recess portion for guiding said developer toward said first developer supply port by rotation of said cartridge main body.

16. The image forming apparatus of claim 15, wherein said developer supply portion of said developer cartridge further includes an inclined surface portion for sliding and falling said developer, having been guided to said developer supply port by said guiding-recess portion, to said image forming apparatus.

* * * * *